US011203458B2

(12) United States Patent
Sollie et al.

(10) Patent No.: US 11,203,458 B2
(45) **Date of Patent: *Dec. 21, 2021**

(54) INSULATED BOX ASSEMBLY WITH OVERLAPPING PANELS

(71) Applicant: Pratt Retail Specialties, LLC, Conyers, GA (US)

(72) Inventors: Greg Sollie, Sharpsburg, GA (US); Jamie Waitermire, Peachtree City, GA (US); Shifeng Chen, Newport News, VA (US)

(73) Assignee: Pratt Retail Specialties, LLC, Conyers, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/879,811

(22) Filed: May 21, 2020

(65) Prior Publication Data

US 2020/0283188 A1 Sep. 10, 2020

Related U.S. Application Data

(63) Continuation of application No. 16/382,710, filed on Apr. 12, 2019, now Pat. No. 10,858,141.

(Continued)

(51) Int. Cl.
*B65D 5/22* (2006.01)
*B31B 50/26* (2017.01)

(Continued)

(52) U.S. Cl.
CPC ..... *B65D 5/22* (2013.01); *B31B 50/262* (2017.08); *B65D 5/2057* (2013.01); *B65D 5/64* (2013.01);

(Continued)

(58) Field of Classification Search
CPC ..... B65D 5/22; B65D 5/2057; B65D 5/64; B65D 81/3858; B65D 81/3862;

(Continued)

(56) References Cited

U.S. PATENT DOCUMENTS 265,985 A 10/1882 Seabury
1,527,167 A 2/1925 Birdseye (Continued)

FOREIGN PATENT DOCUMENTS

CA 2019104 12/1991
CN 1503962 6/2004

(Continued)

OTHER PUBLICATIONS

US 10,562,676 B2, 02/2020, Waltermire et al. (withdrawn)

(Continued)

*Primary Examiner* — Christopher R Demeree
(74) *Attorney, Agent, or Firm* — Taylor English Duma LLP

(57) ABSTRACT

A box assembly includes an exterior piece including a middle portion; a connecting segment coupled to the middle portion by a fold line; and a end segment coupled to the connecting segment by a fold line, the connecting segment positioned substantially perpendicular to the middle portion and the end segment; an interior piece positioned within the exterior piece, the interior piece including a side panel, a space defined between the middle portion and the side panel, the interior piece defining a cavity, the end segment extending into the cavity, the end segment coupled to the side panel; and an insulator positioned at least partially within the space.

9 Claims, 25 Drawing Sheets

Related U.S. Application Data

(60) Provisional application No. 62/760,672, filed on Nov. 13, 2018.

(51) Int. Cl.

| | |
|---|---|
| ***B65D 5/64*** | (2006.01) |
| ***B65D 5/20*** | (2006.01) |
| ***B65D 81/38*** | (2006.01) |
| ***B65D 25/02*** | (2006.01) |
| *B31B 110/35* | (2017.01) |

(52) U.S. Cl.
CPC ..... *B65D 25/02* (2013.01); *B65D 81/386* (2013.01); *B65D 81/3858* (2013.01); *B31B 2110/35* (2017.08)

(58) Field of Classification Search
CPC ..... B65D 81/3823; B65D 81/3813; B65D 5/566; B65D 77/042; B65D 1/22; B65D 21/00; B65D 5/56; B65D 81/38; B65D 81/3825; F25D 2331/804; F25D 2323/061; B32B 2307/304
USPC ..... 229/103.11, 122.32, 122.34; 220/592.25, 220/592.2, 592.26, 4.29, 592.23; 206/594, 545; 312/259; 62/60
See application file for complete search history.

(56) References Cited

U.S. PATENT DOCUMENTS 1,677,565 A 7/1928 Oppenheim
1,682,410 A 8/1928 Oppenheim
1,747,980 A 2/1930 Kondolf
1,753,813 A 4/1930 Washburn
1,868,996 A 7/1932 Sharp
1,896,393 A 2/1933 Devine
1,899,892 A 2/1933 D'Este et al.
1,930,680 A 10/1933 Hinton
1,935,923 A 11/1933 Thoke
1,937,263 A 11/1933 Bubb
1,942,917 A 1/1934 D'Este et al.
1,954,013 A 4/1934 Lilienfield
2,018,519 A 10/1935 Hall
2,070,747 A 2/1937 Ostrom
2,116,513 A 5/1938 Frankenstein
2,148,454 A 2/1939 Gerard
2,165,327 A 7/1939 Zalkind
2,289,060 A 7/1942 Merkle
2,293,361 A * 8/1942 Roberts ..... B65D 5/5095 229/122.32
2,360,806 A 10/1944 Van Rosen
2,386,905 A 10/1945 Meitzen
2,389,601 A 11/1945 De Witt
2,485,643 A 10/1949 Norquist
2,554,004 A 5/1951 Bergstein
2,632,311 A 3/1953 Sullivan
2,650,016 A 8/1953 McMillan
2,753,102 A 7/1956 Paige
2,867,035 A 1/1959 Patterson, Jr.
2,899,103 A 8/1959 Ebert
2,927,720 A 3/1960 Adams
2,986,324 A 5/1961 Anderson, Jr.
2,987,239 A 6/1961 Atwood
3,029,008 A 4/1962 Membrino
3,031,121 A 4/1962 Chase
3,065,895 A 11/1962 Lipschutz
3,096,879 A 7/1963 Schumacher
3,097,782 A 7/1963 Koropatkin et al.
3,182,913 A 5/1965 Brian
3,193,176 A 7/1965 Gullickson et al.
3,194,471 A 7/1965 Murphy
3,222,843 A 12/1965 Schneider
3,236,206 A 2/1966 Willinger
3,282,411 A 11/1966 Jardine
3,286,825 A 11/1966 Laas
3,335,941 A 8/1967 Gatward
3,371,462 A 3/1968 Nordkvist et al.
3,375,934 A 4/1968 Bates
3,399,818 A 9/1968 Stegner
3,420,363 A 1/1969 Blickensderfer
3,435,736 A 4/1969 Reiche
3,465,948 A 9/1969 Boyer
3,503,550 A 3/1970 Main et al.
3,551,945 A 1/1971 Eyberg et al.
3,670,948 A 6/1972 Berg
3,703,383 A 11/1972 Kuchenbecker
3,734,336 A 5/1973 Rankow et al.
3,747,743 A 7/1973 Hoffman, Jr.
3,749,299 A 7/1973 Ingle
3,836,044 A 9/1974 Tilp et al.
3,843,038 A 10/1974 Sax
3,880,341 A 4/1975 Bamburg et al.
3,887,743 A 6/1975 Lane
3,890,762 A 6/1975 Ernst et al.
3,980,005 A 9/1976 Buonaiuto
4,030,227 A 6/1977 Oftedahl
4,050,264 A 9/1977 Tanaka
4,068,779 A 1/1978 Canfield
4,091,852 A 5/1978 Jordan et al.
4,169,540 A * 10/1979 Larsson ..... B65D 77/062 206/205
4,170,304 A 10/1979 Huke
4,211,267 A 7/1980 Skovgaard
4,213,310 A 7/1980 Buss
4,335,844 A 6/1982 Egli
4,342,416 A 8/1982 Philips
4,380,314 A 4/1983 Langston, Jr. et al.
4,396,144 A 8/1983 Gutierrez et al.
4,418,864 A 12/1983 Neilsen
4,488,623 A 12/1984 Linnell, II et al.
4,509,645 A 4/1985 Hotta
4,679,242 A 7/1987 Brockhaus
4,682,708 A 7/1987 Pool
4,797,010 A 1/1989 Coelho
4,819,793 A 4/1989 Willard et al.
4,828,133 A 5/1989 Hougendobler
4,830,282 A 5/1989 Knight, Jr.
4,889,252 A 12/1989 Rockom et al.
4,930,903 A 6/1990 Mahoney
4,989,780 A 2/1991 Foote et al.
5,016,813 A 5/1991 Simons
5,020,481 A 6/1991 Nelson
5,062,527 A 11/1991 Westerman
5,094,547 A 3/1992 Graham
5,102,004 A 4/1992 Hollander et al.
5,154,309 A 10/1992 Wischusen, III et al.
5,158,371 A 10/1992 Moravek
5,165,583 A 11/1992 Kouwenberg
5,185,904 A 2/1993 Rogers et al.
5,226,542 A 7/1993 Boecker et al.
5,230,450 A 7/1993 Mahvi et al.
5,263,339 A 11/1993 Evans
5,358,757 A 10/1994 Robinette et al.
5,372,429 A 12/1994 Beaver, Jr. et al.
5,417,342 A 5/1995 Hutchison
5,418,031 A 5/1995 English
5,441,170 A 8/1995 Bane, III
5,454,471 A 10/1995 Norvell
5,491,186 A 2/1996 Kean et al.
5,493,874 A 2/1996 Landgrebe
5,499,473 A 3/1996 Ramberg
5,505,810 A 4/1996 Kirby et al.
5,511,667 A 4/1996 Carder
5,512,345 A 4/1996 Tsutsumi et al.
5,516,580 A 5/1996 Frenette et al.
5,562,228 A 10/1996 Ericson
5,573,119 A 11/1996 Luray
5,596,880 A 1/1997 Welker et al.
5,601,232 A 2/1997 Greenlee
5,613,610 A 3/1997 Bradford
5,615,795 A 4/1997 Tipps
5,638,978 A 6/1997 Cadiente
5,775,576 A 7/1998 Stone

(56) References Cited

U.S. PATENT DOCUMENTS

| | | | |
|---|---|---|---|
| 5,842,571 | A | 12/1998 | Rausch |
| 5,906,290 | A | 5/1999 | Haberkorn |
| 5,996,366 | A | 12/1999 | Renard |
| 6,003,719 | A | 12/1999 | Steward, III |
| 6,041,958 | A | 3/2000 | Tremelo |
| 6,048,099 | A | 4/2000 | Muffett et al. |
| 6,050,410 | A | 4/2000 | Quirion |
| 6,050,412 | A | 4/2000 | Clough et al. |
| 6,138,902 | A | 10/2000 | Welch |
| 6,164,526 | A | 12/2000 | Dalvey |
| 6,168,040 | B1 | 1/2001 | Sautner et al. |
| 6,220,473 | B1 | 4/2001 | Lehman et al. |
| 6,223,551 | B1 | 5/2001 | Mitchell |
| 6,238,091 | B1 | 5/2001 | Mogil |
| 6,244,458 | B1 | 6/2001 | Frysinger et al. |
| 6,247,328 | B1 | 6/2001 | Mogil |
| 6,295,830 | B1 | 10/2001 | Newman |
| 6,295,860 | B1 | 10/2001 | Sakairi et al. |
| 6,296,134 | B1 | 10/2001 | Cardinale |
| 6,308,850 | B1 | 10/2001 | Coom et al. |
| 6,325,281 | B1 | 12/2001 | Grogan |
| 6,443,309 | B1 | 9/2002 | Becker |
| 6,453,682 | B1 | 9/2002 | Jennings et al. |
| 6,478,268 | B1 | 11/2002 | Bidwell et al. |
| 6,510,705 | B1 | 1/2003 | Jackson |
| 6,582,124 | B2 | 6/2003 | Mogil |
| 6,618,868 | B2 | 9/2003 | Minnick |
| 6,688,133 | B1 | 2/2004 | Donefrio |
| 6,725,783 | B2 | 4/2004 | Sekino |
| 6,726,017 | B2 | 4/2004 | Maresh et al. |
| 6,736,309 | B1 | 5/2004 | Westerman et al. |
| 6,771,183 | B2 | 8/2004 | Hunter |
| 6,821,019 | B2 | 11/2004 | Mogil |
| 6,837,420 | B2 | 1/2005 | Westerman et al. |
| 6,868,982 | B2 | 3/2005 | Gordon |
| 6,875,486 | B2 | 4/2005 | Miller |
| 6,899,229 | B2 | 5/2005 | Dennison et al. |
| 6,910,582 | B2 | 6/2005 | Lantz |
| 6,913,389 | B2 | 7/2005 | Kannankeril et al. |
| 6,971,539 | B1 | 12/2005 | Abbe |
| 7,000,962 | B2 | 2/2006 | Le |
| 7,019,271 | B2 | 3/2006 | Wnek et al. |
| 7,070,841 | B2 | 7/2006 | Benim et al. |
| 7,094,192 | B2 | 8/2006 | Schoenberger et al. |
| 7,140,773 | B2 | 11/2006 | Becker et al. |
| 7,225,632 | B2 | 6/2007 | Derifield |
| 7,225,970 | B2 | 6/2007 | Philips |
| 7,229,677 | B2 | 6/2007 | Miller |
| 7,264,147 | B1 | 9/2007 | Benson et al. |
| 7,392,931 | B2 | 7/2008 | Issler |
| 7,452,316 | B2 | 11/2008 | Cals et al. |
| D582,676 | S | 12/2008 | Rothschild |
| 7,484,623 | B2 | 2/2009 | Goodrich |
| 7,597,209 | B2 | 10/2009 | Rothschild et al. |
| 7,607,563 | B2 | 10/2009 | Hanna et al. |
| 7,677,406 | B2 | 3/2010 | Maxson |
| 7,681,405 | B2 | 3/2010 | Williams |
| 7,784,301 | B2 | 8/2010 | Sasaki et al. |
| 7,807,773 | B2 | 10/2010 | Matsuoka et al. |
| 7,841,512 | B2 | 11/2010 | Westerman et al. |
| 7,845,508 | B2 | 12/2010 | Rothschild et al. |
| 7,870,992 | B2 | 1/2011 | Schille et al. |
| 7,909,806 | B2 | 3/2011 | Goodman et al. |
| 7,971,720 | B2 | 7/2011 | Minkler |
| 8,118,177 | B2 | 2/2012 | Drapela et al. |
| 8,209,995 | B2 | 7/2012 | Kieling et al. |
| 8,210,353 | B2 | 7/2012 | Epicureo |
| 8,343,024 | B1 | 1/2013 | Contanzo, Jr. et al. |
| 8,365,943 | B2 | 2/2013 | Bentley |
| 8,465,404 | B2 | 6/2013 | Hadley |
| 8,579,183 | B2 | 11/2013 | Belfort et al. |
| 8,596,520 | B2 | 12/2013 | Scott |
| 8,613,202 | B2 | 12/2013 | Williams |
| 8,651,593 | B2 | 2/2014 | Bezich et al. |
| 8,763,811 | B2 | 7/2014 | Lantz |
| 8,763,886 | B2 | 7/2014 | Hall |
| 8,795,470 | B2 | 8/2014 | Henderson et al. |
| 8,919,082 | B1 | 12/2014 | Cataldo |
| 8,960,528 | B2 | 2/2015 | Sadlier |
| 9,272,475 | B2 | 3/2016 | Ranade et al. |
| 9,290,313 | B2 | 3/2016 | De Lesseux et al. |
| 9,322,136 | B2 | 4/2016 | Ostendorf et al. |
| D758,182 | S | 6/2016 | Sponselee |
| 9,394,633 | B2 | 7/2016 | Shimotsu et al. |
| 9,408,445 | B2 | 8/2016 | Mogil et al. |
| 9,429,350 | B2 | 8/2016 | Chapman, Jr. |
| 9,499,294 | B1 | 11/2016 | Contanzo, Jr. |
| 9,550,618 | B1 | 1/2017 | Jobe |
| 9,605,382 | B2 | 3/2017 | Virtanen |
| 9,611,067 | B2 | 4/2017 | Collison |
| 9,635,916 | B2 | 5/2017 | Bezich et al. |
| 9,701,437 | B2 | 7/2017 | Bugas et al. |
| 9,738,420 | B2 | 8/2017 | Miller |
| 9,738,432 | B1 | 8/2017 | Petrucci et al. |
| 9,834,366 | B2 | 12/2017 | Giuliani |
| 9,908,680 | B2 | 3/2018 | Shi et al. |
| 9,908,684 | B2 | 3/2018 | Collison |
| 9,920,517 | B2 | 3/2018 | Sollie et al. |
| 9,950,830 | B2 | 4/2018 | De Lesseux et al. |
| 9,981,797 | B2 | 5/2018 | Aksan et al. |
| 10,046,901 | B1 | 8/2018 | Jobe |
| 10,094,126 | B2 | 10/2018 | Collison et al. |
| 10,112,756 | B2 | 10/2018 | Menzel, Jr. |
| 10,226,909 | B2 | 3/2019 | Frem et al. |
| 10,266,332 | B2 | 4/2019 | Aksan et al. |
| 10,357,936 | B1 | 7/2019 | Vincent et al. |
| 10,442,600 | B2 | 10/2019 | Waltermire et al. |
| 10,507,968 | B2 | 12/2019 | Sollie et al. |
| 10,551,110 | B2 | 2/2020 | Waltermire et al. |
| 10,583,977 | B2 | 3/2020 | Collison et al. |
| 10,604,304 | B2 | 3/2020 | Waltermire et al. |
| 10,800,595 | B2 | 10/2020 | Waltermire et al. |
| 10,843,840 | B2 | 11/2020 | Sollie et al. |
| 10,858,141 | B2 | 12/2020 | Sollie et al. |
| 10,882,681 | B2 | 1/2021 | Waltermire et al. |
| 10,882,682 | B2 | 1/2021 | Collison et al. |
| 10,882,683 | B2 | 1/2021 | Collison et al. |
| 10,882,684 | B2 | 1/2021 | Sollie et al. |
| 10,926,939 | B2 | 2/2021 | Collison et al. |
| 10,941,977 | B2 | 3/2021 | Waltermire et al. |
| 10,947,025 | B2 | 3/2021 | Sollie et al. |
| 10,954,057 | B2 | 3/2021 | Waltermire et al. |
| 10,954,058 | B2 | 3/2021 | Sollie et al. |
| 11,027,875 | B2 | 6/2021 | Sollie et al. |
| 11,059,652 | B2 | 7/2021 | Sollie et al. |
| 11,066,228 | B2 | 7/2021 | Sollie et al. |
| 11,117,731 | B2 | 9/2021 | Waltermire et al. |
| 11,124,354 | B2 | 9/2021 | Waltermire et al. |
| 11,137,198 | B2 | 10/2021 | Waltermire et al. |
| 11,148,870 | B2 | 10/2021 | Collison et al. |
| 2001/0010312 | A1 | 8/2001 | Mogil |
| 2002/0020188 | A1 | 2/2002 | Sharon et al. |
| 2002/0064318 | A1 | 5/2002 | Malone et al. |
| 2002/0162767 | A1 | 11/2002 | Ohtsubo |
| 2003/0145561 | A1 | 8/2003 | Cals et al. |
| 2004/0004111 | A1 | 1/2004 | Cardinale |
| 2004/0031842 | A1 | 2/2004 | Westerman et al. |
| 2004/0079794 | A1 | 4/2004 | Mayer |
| 2005/0109655 | A1 | 5/2005 | Vershum et al. |
| 2005/0117817 | A1 | 6/2005 | Mogil et al. |
| 2005/0189404 | A1 | 9/2005 | Xiaohai et al. |
| 2005/0214512 | A1 | 9/2005 | Fascio |
| 2005/0224501 | A1 | 10/2005 | Folkert et al. |
| 2005/0279963 | A1 | 12/2005 | Church et al. |
| 2006/0053828 | A1 | 3/2006 | Shallman et al. |
| 2006/0078720 | A1 | 4/2006 | Toas et al. |
| 2006/0096978 | A1 | 5/2006 | Lafferty et al. |
| 2006/0193541 | A1 | 8/2006 | Norcom |
| 2006/0243784 | A1 | 11/2006 | Glaser et al. |
| 2007/0000932 | A1 | 1/2007 | Cron et al. |
| 2007/0000983 | A1 | 1/2007 | Spurrell et al. |
| 2007/0051782 | A1 | 3/2007 | Lantz |
| 2007/0193298 | A1 | 8/2007 | Derifield |
| 2007/0209307 | A1 | 9/2007 | Andersen |

(56) References Cited

U.S. PATENT DOCUMENTS

2007/0257040 A1 11/2007 Price, Jr. et al.
2008/0095959 A1 4/2008 Warner et al.
2008/0135564 A1 6/2008 Romero
2008/0173703 A1 7/2008 Westerman et al.
2008/0190940 A1 8/2008 Scott
2008/0203090 A1 8/2008 Dickinson
2008/0289302 A1 11/2008 Vulpitta
2008/0296356 A1 12/2008 Hatcher et al.
2008/0308616 A1 12/2008 Phung
2008/0314794 A1 12/2008 Bowman
2009/0034883 A1 2/2009 Giuliani
2009/0114311 A1 5/2009 McDowell
2009/0193765 A1 8/2009 Lantz
2009/0214142 A1 8/2009 Bossel et al.
2009/0283578 A1 11/2009 Miller
2009/0288791 A1 11/2009 Hammer et al.
2010/0001056 A1 1/2010 Chandaria
2010/0006630 A1 1/2010 Humphries et al.
2010/0062921 A1 3/2010 Veiseh
2010/0072105 A1 3/2010 Glaser et al.
2010/0139878 A1 6/2010 Clemente
2010/0151164 A1 6/2010 Grant et al.
2010/0258574 A1 10/2010 Bentley
2010/0270317 A1 10/2010 Kieling et al.
2010/0282827 A1 11/2010 Padovani
2010/0284634 A1 11/2010 Hadley
2010/0314397 A1 12/2010 Williams et al.
2010/0314437 A1 12/2010 Dowd
2011/0042449 A1 2/2011 Copenhaver et al.
2011/0100868 A1 5/2011 Lantz
2011/0114513 A1 5/2011 Miller
2011/0235950 A1 9/2011 Lin
2011/0284556 A1 11/2011 Palmer et al.
2011/0311758 A1 12/2011 Burns et al.
2011/0317944 A1 12/2011 Liu
2012/0031957 A1 2/2012 Whitaker
2012/0074823 A1 3/2012 Bezich et al.
2012/0145568 A1 6/2012 Collison et al.
2012/0243808 A1 9/2012 De Lesseux et al.
2012/0248101 A1 10/2012 Tumber et al.
2012/0251818 A1 10/2012 Axrup et al.
2012/0279896 A1 11/2012 Lantz
2013/0112694 A1 5/2013 Bentley
2013/0112695 A1 5/2013 Hall
2013/0140317 A1* 6/2013 Roskoss ..... B65D 81/3823 220/592.25
2014/0000306 A1 1/2014 Chapman, Jr.
2014/0021208 A1* 1/2014 Anti ..... A01N 1/0273 220/592.25
2014/0093697 A1 4/2014 Perry et al.
2014/0248003 A1 9/2014 Mogil et al.
2014/0319018 A1* 10/2014 Collison ..... B65D 81/3858 206/589
2014/0367393 A1* 12/2014 Ranade ..... B32B 37/24 220/592.25
2015/0110423 A1 4/2015 Fox et al.
2015/0166244 A1 6/2015 Wood et al.
2015/0175338 A1 6/2015 Culp et al.
2015/0238033 A1 8/2015 Zavitsanos
2015/0239639 A1 8/2015 Wenner et al.
2015/0259126 A1 9/2015 McGoff et al.
2015/0284131 A1 10/2015 Genender et al.
2015/0345853 A1 12/2015 Oeyen
2016/0015039 A1 1/2016 Pierce
2016/0052696 A1 2/2016 Cook et al.
2016/0060017 A1 3/2016 De Lesseux et al.
2016/0264294 A1 9/2016 Bacon
2016/0304267 A1 10/2016 Aksan
2016/0325915 A1 11/2016 Aksan
2017/0015080 A1 1/2017 Collison et al.
2017/0043937 A1 2/2017 Lantz
2017/0144792 A1 5/2017 Block
2017/0198959 A1 7/2017 Morris
2017/0225870 A1 8/2017 Collison
2017/0233134 A9 8/2017 Grajales et al.
2017/0283157 A1 10/2017 Jobe
2017/0305639 A1 10/2017 Kuhn et al.
2017/0320653 A1 11/2017 Mogil et al.
2017/0334622 A1 11/2017 Menzel, Jr.
2017/0341847 A1 11/2017 Chase et al.
2017/0361973 A1 12/2017 Padilla
2017/0369226 A1 12/2017 Chase et al.
2018/0050857 A1 2/2018 Collison
2018/0051460 A1 2/2018 Sollie et al.
2018/0148246 A1 5/2018 Fu et al.
2018/0194534 A1 7/2018 Jobe
2018/0215525 A1 8/2018 Vogel et al.
2018/0229917 A1 8/2018 Jobe
2018/0237207 A1 8/2018 Aksan et al.
2018/0274837 A1 9/2018 Christensen
2018/0290813 A1 10/2018 Waltermire et al.
2018/0290815 A1 10/2018 Waltermire et al.
2018/0299059 A1 10/2018 McGoff et al.
2018/0327171 A1 11/2018 Waltermire et al.
2018/0327172 A1 11/2018 Waltermire et al.
2018/0334308 A1 11/2018 Moore et al.
2018/0335241 A1 11/2018 Li et al.
2019/0032991 A1 1/2019 Waltermire et al.
2019/0047775 A1 2/2019 Waltermire et al.
2019/0185246 A1 6/2019 Sollie et al.
2019/0185247 A1 6/2019 Sollie et al.
2019/0193916 A1 6/2019 Waltermire et al.
2019/0210790 A1 7/2019 Rizzo et al.
2019/0234679 A1 8/2019 Waltermire et al.
2019/0248573 A1 8/2019 Collison et al.
2019/0270572 A1 9/2019 Collison et al.
2019/0270573 A1 9/2019 Collison et al.
2019/0352075 A1 11/2019 Waltermire et al.
2019/0352076 A1 11/2019 Waltermire et al.
2019/0352080 A1 11/2019 Waltermire et al.
2019/0359412 A1 11/2019 Sollie et al.
2019/0359413 A1 11/2019 Sollie et al.
2019/0359414 A1 11/2019 Sollie et al.
2019/0367209 A1 12/2019 Jobe
2019/0376636 A1 12/2019 Fellinger et al.
2019/0382186 A1 12/2019 Sollie et al.
2019/0390892 A1 12/2019 Waltermire et al.
2020/0071056 A1 3/2020 Henderson et al.
2020/0088458 A1 3/2020 Waltermire et al.
2020/0103159 A1 4/2020 Waltermire et al.
2020/0122896 A1 4/2020 Waltermire et al.
2020/0148409 A1 5/2020 Sollie et al.
2020/0148410 A1 5/2020 Sollie et al.
2020/0148453 A1 5/2020 Sollie et al.
2020/0346816 A1 11/2020 Sollie et al.
2020/0346841 A1 11/2020 Sollie et al.
2021/0039869 A1 2/2021 Waltermire et al.
2021/0039870 A1 2/2021 Sollie et al.
2021/0039871 A1 2/2021 Sollie et al.
2021/0070527 A1 3/2021 Sollie et al.
2021/0070529 A1 3/2021 Sollie et al.
2021/0070530 A1 3/2021 Sollie et al.
2021/0101734 A1 4/2021 Collison et al.
2021/0101735 A1 4/2021 Collison et al.
2021/0101736 A1 4/2021 Waltermire et al.
2021/0101737 A1 4/2021 Waltermire et al.
2021/0102746 A1 4/2021 Waltermire et al.
2021/0155367 A1 5/2021 Sollie et al.
2021/0163210 A1 6/2021 Waltermire et al.
2021/0179313 A1 6/2021 Sollie et al.
2021/0179337 A1 6/2021 Sollie et al.

FOREIGN PATENT DOCUMENTS

CN 102264961 11/2011
CN 206494316 9/2017
CN 108001787 5/2018
DE 1897846 7/1964
DE 102011016500 10/2012
DE 202017103230 7/2017
DE 202017003908 10/2017
EP 0133539 2/1985
EP 0537058 4/1993
EP 2990196 3/2016

(56) References Cited

FOREIGN PATENT DOCUMENTS

| | | |
|---|---|---|
| FR | 1241878 | 9/1960 |
| FR | 2705317 | 11/1994 |
| FR | 2820718 | 8/2002 |
| FR | 2821786 | 9/2002 |
| FR | 3016352 | 7/2015 |
| GB | 217683 | 6/1924 |
| GB | 235673 | 6/1925 |
| GB | 528289 | 1/1940 |
| GB | 713640 | 8/1954 |
| GB | 1204058 | 9/1970 |
| GB | 1305212 | 1/1973 |
| GB | 1372054 | 10/1974 |
| GB | 2400096 | 5/2006 |
| GB | 2516490 | 1/2015 |
| GB | 2528289 | 1/2016 |
| JP | 01254557 | 10/1989 |
| JP | 2005139582 | 6/2005 |
| JP | 2005247329 | 9/2005 |
| JP | 2012126440 | 7/2012 |
| WO | 8807476 | 10/1988 |
| WO | 9726192 | 7/1997 |
| WO | 9932374 | 7/1999 |
| WO | 2001070592 | 9/2001 |
| WO | 2014147425 | 9/2014 |
| WO | 2016187435 | 5/2016 |
| WO | 2016187435 | 11/2016 |
| WO | 2018089365 | 5/2018 |
| WO | 2018093586 | 5/2018 |
| WO | 2018227047 | 12/2018 |
| WO | 2019125904 | 6/2019 |
| WO | 2019125906 | 6/2019 |
| WO | 2019226199 | 11/2019 |
| WO | 2020101939 | 5/2020 |
| WO | 2020102023 | 5/2020 |
| WO | 2020122921 | 6/2020 |
| WO | 2020222943 | 11/2020 |

OTHER PUBLICATIONS

US 10,899,530 B2, 01/2021, Sollie et al. (withdrawn)
US 10,899,531 B2, 01/2021, Sollie et al. (withdrawn)
US 11,027,908 B2, 06/2021, Sollie et al. (withdrawn)
US 11,040,817 B2, 06/2021, Sollie et al. (withdrawn)
US 11,072,486 B2, 07/2021, Waltermire et al. (withdrawn)
US 11,079,168 B2, 08/2021, Waltermire et al. (withdrawn)
US 11,084,644 B2, 08/2021, Waltermire et al. (withdrawn)
Waltermire, Jamie; Corrected Notice of Allowance for U.S. Appl. No. 15/482,186, filed Apr. 7, 2017, dated Sep. 2, 2020, 12 pgs.
Waltermire, Jamie; Corrected Notice of Allowance for U.S. Appl. No. 16/526,511, filed Jul. 30, 2019, dated Oct. 30, 2020, 14 pgs.
Waltermire, Jamie; Notice of Allowance for U.S. Appl. No. 16/526,511, filed Jul. 30, 2019, dated Sep. 14, 2020, 18 pgs.
Waltermire, Jamie; Corrected Notice of Allowance for U.S. Appl. No. 15/590,349, filed May 9, 2017, dated Nov. 2, 2020, 9 pgs.
Waltermire, Jamie; Notice of Allowance for U.S. Appl. No. 15/590,349, filed May 9, 2017, dated Oct. 20, 2020, 20 pgs.
Waltermire, Jamie; Final Office Action for U.S. Appl. No. 16/293,716, filed Mar. 6, 2019, dated Oct. 29, 2020, 19 pgs.
Waltermire, Jamie; Final Office Action for U.S. Appl. No. 16/293,716, filed Mar. 6, 2019, dated Sep. 10, 2020, 24 pgs.
Waltermire, Jamie; Non-Final Office Action for U.S. Appl. No. 16/526,555, filed Jul. 30, 2019, dated Oct. 27, 2020, 39 pgs.
Waltermire, Jamie; Final Office Action for U.S. Appl. No. 16/381,678, filed Apr. 11, 2019, dated Oct. 19, 2020, 24 pgs.
Waltermire, Jamie; Final Office Action for U.S. Appl. No. 16/381,678, filed Apr. 11, 2019, dated Aug. 20, 2020, 21 pgs.
Waltermire, Jamie; Final Office Action for U.S. Appl. No. 16/561,203, filed Sep. 5, 2019, dated Sep. 10, 2020, 25 pgs.
Waltermire, Jamie; Notice of Allowance for U.S. Appl. No. 16/561,203, filed Sep. 5, 2019, dated Nov. 3, 2020, 14 pgs.
Waltermire, Jamie; Requirement for Restriction/Election for U.S. Appl. No. 16/689,407, filed Nov. 20, 2019, dated Oct. 29, 2020, 6 pgs.
Waltermire, Jamie; Requirement for Restriction/Election for U.S. Appl. No. 16/689,433, filed Nov. 20, 2019, dated Oct. 16, 2020, 6 pgs.
Sollie, Greg; Corrected Notice of Allowance for U.S. Appl. No. 16/552,277, filed Aug. 27, 2019, dated Nov. 5, 2020, 9 pgs.
Sollie, Greg; Notice of Allowance for U.S. Appl. No. 16/552,277, filed Aug. 27, 2019, dated Aug. 31, 2020, 6 pgs.
Sollie, Greg; Final Office Action for U.S. Appl. No. 15/845,540, filed Dec. 18, 2017, dated Sep. 2, 2020, 28 pgs.
Sollie, Greg; Notice of Allowance for U.S. Appl. No. 15/845,540, filed Dec. 18, 2017, dated Sep. 17, 2020, 5 pgs.
Collison, Alan B.; Advisory Action for U.S. Appl. No. 16/658,756, filed Oct. 21, 2019, dated Sep. 25, 2020, 4 pgs.
Collison, Alan B.; Notice of Allowance for U.S. Appl. No. 16/658,756, filed Oct. 21, 2019, dated Oct. 23, 2020, 10 pgs.
Collison, Alan B.; Applicant-Initiated Interview Summary for U.S. Appl. No. 16/414,309, filed May 16, 2019, dated Aug. 21, 2020, 3 pgs.
Collison, Alan B.; Applicant-Initiated Interview Summary for U.S. Appl. No. 16/414,309, filed May 16, 2019, dated Oct. 15, 2020, 3 pgs.
Collison, Alan B.; Final Office Action for U.S. Appl. No. 16/414,309, filed May 16, 2019, dated Oct. 8, 2020, 15 pgs.
Collison, Alan B.; Notice of Allowance for U.S. Appl. No. 16/414,309, filed May 16, 2019, dated Oct. 21, 2020, 6 pgs.
Collison, Alan; Final Office Action for U.S. Appl. No. 16/414,310, filed May 16, 2019, dated Oct. 13, 2020, 30 pgs.
Sollie, Greg; Final Office Action for U.S. Appl. No. 15/988,550, filed May 24, 2018, dated Aug. 27, 2020, 27 pgs.
Sollie, Greg; Non-Final Office Action for U.S. Appl. No. 16/280,595, filed Feb. 20, 2019, dated Aug. 28, 2020, 26 pgs.
Sollie, Greg; Final Office Action for U.S. Appl. No. 16/530,052, filed Aug. 2, 2019, dated Aug. 28, 2020, 29 pgs.
Sollie, Greg; Corrected Notice of Allowance for U.S. Appl. No. 16/401,603, filed May 2, 2019, dated Nov. 3, 2020, 9 pgs.
Sollie, Greg; Notice of Allowance for U.S. Appl. No. 16/401,603, filed May 2, 2019, dated Aug. 31, 2020, 14 pgs.
Sollie, Greg; Non-Final Office Action for U.S. Appl. No. 16/401,607, filed May 2, 2019, dated Aug. 19, 2020, 38 pgs.
Sollie, Greg; Corrected Notice of Allowance for U.S. Appl. No. 16/382,710, filed Apr. 12, 2019, dated Sep. 24, 2020, 9 pgs.
Sollie, Greg; Notice of Allowance for U.S. Appl. No. 16/382,710, filed Apr. 12, 2019, dated Oct. 21, 2020, 5 pgs.
Sollie, Greg; Corrected Notice of Allowance for U.S. Appl. No. 16/567,192, filed Sep. 11, 2019, dated Oct. 20, 2020, 8 pgs.
Sollie, Greg; Non-Final Office Action for U.S. Appl. No. 16/408,981, filed May 10, 2019, dated Sep. 16, 2020, 40 pgs.
MP Global Products LLC: European Search Report Response for serial No. 17868605.1, filed Oct. 2, 2020, 15 pgs.
Waltermire, Jamie; Certificate of Correction for U.S. Appl. No. 15/482,186, filed Apr. 7, 2017, dated Dec. 29, 2020, 1 pg.
Waltermire, Jamie; Corrected Notice of Allowance for U.S. Appl. No. 15/590,349, filed May 9, 2017, dated Feb. 5, 2021, 9 pgs.
Waltermire, Jamie; Non-Final Office Action for U.S. Appl. No. 16/293,716, filed Mar. 6, 2019, dated Feb. 5, 2021, 18 pgs.
Waltermire, Jamie; Corrected Notice of Allowance for U.S. Appl. No. 16/561,203, filed Sep. 5, 2019, dated Feb. 5, 2021, 8 pgs.
Waltermire, Jamie; Non-Final Office Action for U.S. Appl. No. 16/689,407, filed Nov. 20, 2019, dated Jan. 8, 2021, 92 pgs.
Sollie, Greg; Corrected Notice of Allowance for U.S. Appl. No. 16/552,277, filed Aug. 27, 2019, dated Feb. 9, 2021, 9 pgs.
Sollie, Greg; Corrected Notice of Allowance for U.S. Appl. No. 15/845,540, filed Dec. 18, 2017, dated Feb. 12, 2021, 8 pgs.
Collison, Alan B.; Corrected Notice of Allowance for U.S. Appl. No. 16/658,756, filed Oct. 21, 2019, dated Jan. 28, 2021, 3 pgs.
MP Global Products LLC: Office Action for European application No. 17868605.1, dated Dec. 3, 2020, 4 pgs.
MP Global Products, LLC; Examination Report for Australian patent application No. 2017359035, dated Nov. 27, 2020, 3 pgs.

(56) References Cited

OTHER PUBLICATIONS

MP Global Products, LLC; Office Action for Chinese patent application No. 201780081689.7, dated Nov. 2, 2020, 17 pgs.
Collison, Alan B.; Non-Final Office Action for U.S. Appl. No. 17/123,676, filed Dec. 16, 2020, dated Feb. 3, 2021, 23 pgs.
Sollie, Greg; Certificate of Correction for U.S. Appl. No. 16/567,192, filed Sep. 11, 2019, dated Feb. 16, 2021, 1 pg.
MP Global Products, LLC; First Examination Report for Australian patent application No. 2017359035, filed Nov. 7, 2017, dated Nov. 27, 2020, 3 pgs.
MP Global Products LLC: European Office Action for application No. 17868605.1, dated Dec. 3, 2020, 4 pgs.
MP Global Products LLC: European Office Action Response for application No. 17868605.1, filed Jan. 19, 2021, 15 pgs.
Waltermire, Jamie; Notice of Allowance for U.S. Appl. No. 16/164,933, filed Oct. 19, 2018, dated May 14, 2021, 24 pgs.
Waltermire, Jamie; Final Office Action for U.S. Appl. No. 16/526,555, filed Jul. 30, 2019, dated Mar. 8, 2021, 25 pgs.
Waltermire, Jamie; Non-Final Office Action for U.S. Appl. No. 16/381,678, filed Apr. 11, 2019, dated Mar. 5, 2021, 36 pgs.
Waltermire, Jamie; Final Office Action for U.S. Appl. No. 16/689,407, filed Nov. 20, 2019, dated Apr. 23, 2021, 18 pgs.
Waltermire, Jamie; Non-Final Office Action for U.S. Appl. No. 16/689,433, filed Nov. 20, 2019, dated Feb. 23, 2021, 88 pgs.
Collison, Alan B.; Certificate of Correction for U.S. Appl. No. 16/414,309, filed May 16, 2019, dated Mar. 9, 2021, 1 pg.
Collison, Alan B.; Non-Final Office Action for U.S. Appl. No. 17/123,673, filed Dec. 16, 2020, dated Mar. 23, 2021, 86 pgs.
Collison, Alan B.; Applicant-Initiated Interview Summary for U.S. Appl. No. 17/123,676, filed Dec. 16, 2020, dated May 4, 2021, 4 pgs.
Collison, Alan B.; Notice of Allowance for U.S. Appl. No. 17/123,676, filed Dec. 16, 2020, dated May 13, 2021, 93 pgs.
Sollie, Greg; Corrected Notice of Allowance for U.S. Appl. No. 15/988,550, filed May 24, 2018, dated May 10, 2021, 9 pgs.
Sollie, Greg; Notice of Allowance for U.S. Appl. No. 15/988,550, filed May 24, 2018, dated Apr. 13, 2021, 21 pgs.
Sollie, Greg; Non-Final Office Action for U.S. Appl. No. 16/280,595, filed Feb. 20, 2019, dated Apr. 9, 2021, 20 pgs.
Sollie, Greg; Final Office Action for U.S. Appl. No. 16/530,052, filed Aug. 2, 2019, dated Apr. 20, 2021, 27 pgs.
Sollie, Greg; Corrected Notice of Allowance for U.S. Appl. No. 16/401,607, filed May 2, 2019, dated Mar. 15, 2021, 13 pgs.
Sollie, Greg; Corrected Notice of Allowance for U.S. Appl. No. 16/401,607, filed May 2, 2019, dated Apr. 29, 2021, 8 pgs.
Sollie, Greg; Corrected Notice of Allowance for U.S. Appl. No. 16/408,981, filed May 10, 2019, dated Mar. 15, 2021, 9 pgs.
Sollie, Greg; Corrected Notice of Allowance for U.S. Appl. No. 16/408,981, filed May 10, 2019, dated Apr. 29, 2021, 6 pgs.
Sollie, Greg; Notice of Allowance for U.S. Appl. No. 16/408,981, filed May 10, 2019, dated Feb. 23, 2021, 6 pgs.
Sollie, Greg; Non-Final Office Action for U.S. Appl. No. 16/886,040, filed May 28, 2020, dated Mar. 30, 2021, 89 pgs.
MP Global Products LLC: European Office Action for application No. 17868605.1, dated Apr. 13, 2021, 3 pgs.
Collison, Alan. B.; Extended European Search Report for application No. 21160713.0, filed Nov. 7, 2017, dated May 10, 2021, 7 pgs.
Sollie, Greg; Notice of Allowance for U.S. Appl. No. 15/845,545, filed Dec. 18, 2017, dated Jun. 19, 2019, 20 pgs.
Sollie, Greg; Non-Final Office Action for U.S. Appl. No. 15/845,545, filed Dec. 18, 2017, dated Mar. 5, 2019, 41 pgs.
Sollie, Greg; Final Office Action for U.S. Appl. No. 16/552,277, filed Aug. 27, 2019, dated Aug. 7, 2020, 19 pgs.
Sollie, Greg; Non-Final Office Action for U.S. Appl. No. 16/552,277, filed Aug. 27, 2019, dated Jun. 3, 2020, 68 pgs.
Sollie, Greg; Restriction Requirement for U.S. Appl. No. 16/552,277, filed Aug. 27, 2019, dated Apr. 20, 2020, 7 pgs.
Sollie, Greg; Non-Final Office Action for U.S. Appl. No. 15/845,540, filed Dec. 18, 2017, dated Feb. 19, 2020, 32 pgs.
Sollie, Greg; Final Office Action for U.S. Appl. No. 15/845,540, filed Dec. 18, 2017, dated Oct. 30, 2019, 56 pgs.
Sollie, Greg; Non-Final Office Action for U.S. Appl. No. 15/845,540, filed Dec. 18, 2017, dated Apr. 2, 2019, 50 pgs.
weiku.com; Article entitled: "100% Biodegradable Packing materials Green Cell Foam Stock Coolers", located at <http://www.weiku.com/products/18248504/100_Biodegradable_Packing_materials_Green_Cell_Foam_Stock_Coolers.html>, accessed on Sep. 28, 2017, 7 pgs.
Salazar Packaging; Article entitle: "Custom Packaging and Design", located at <https://salazarpackaging.com/custom-packaging-and-design/>, accessed on Sep. 28, 2017, 2 pgs.
Collison, Alan B.; Supplemental Notice of Allowance for U.S. Appl. No. 15/677,738, filed Aug. 15, 2017, dated Dec. 10, 2019, 4 pgs.
Singh, et al; Article entitled: "Performance Comparison of Thermal Insulated Packaging Boxes, Bags and Refrigerants for Single-parcel Shipments", published Mar. 13, 2007, 19 pgs.
Periwrap; Article entitled: "Insulated Solutions", located at <https://www.peri-wrap.com/insulation/>, accessed on Dec. 3, 2018, 9 pgs.
Un Packaging; Article entitled: "CooLiner® Insulated Shipping Bags", available at <http://www.chem-tran.com/packaging/supplies/cooliner-insulated-shipping-bags.php>, accessed on Aug. 30, 2017, 2 pgs.
Greenblue; "Environmental Technical Briefs of Common Packaging Materials—Fiber-Based Materials", Sustainable Packaging Solution, 2009.
MP Global Products; Article entitled: "Thermopod mailer envelopes and Themiokeeper insulated box liners", located at < http://www.mhpn.com/product/thermopod_mailer_envelopes_and_thermokeeper_insulated_box_liners/packaging>, accessed on Aug. 30, 2017, 2 pgs.
Images of Novolex bag, including an outer paper bag, a corrugated cardboard insert, and an inner foil-covered bubble-wrap bag, publicly available prior to May 9, 2017, 7 pgs.
Duro Bag; Article entitled: "The Load and Fold Bag", accessed on May 24, 2017, copyrighted Apr. 2017, 3 pgs.
Tera-Pak; Article entitled: "Insulated Shipping Containers", located at <http://www.tera-pak.com/>, accessed on Mar. 20, 2017, 3 pgs.
American Bag Company; Article entitled: "Cool Green Bag, Small", located at <http://hotcoldbags.com/items/Cool%20Green%20Bag,%20Small>, accessed on Mar. 20, 2017, 2 pgs.
Collison, Alan B.; Notice of Allowance for U.S. Appl. No. 15/677,738, filed Aug. 15, 2017, dated Oct. 29, 2019, 14 pgs.
CooLiner® Insulated Shipping Bags, available at <http://www/chem-tran.com/packaging/supplies/cooliner-insulated-shipping-bags.php>, accessed on Oct. 18, 2019, 4 pgs.
"Green Cell Foam Shipping Coolers", located at <https://www.greencellfoam.com/shipping-coolers>, accessed on Oct. 18, 2019, 4 pgs.
Collison, Alan B.; Corrected Notice of Allowance for U.S. Appl. No. 15/677,738, filed Aug. 15, 2017, dated Jul. 15, 2019, 7 pgs.
Collison, Alan B.; Notice of Allowance for U.S. Appl. No. 15/677,738, filed Aug. 15, 2017, dated Jun. 19, 2019, 10 pgs.
Voluntary Standard for Repulping and Recycling Corrugated Fiberboard Treated to Improve its Performance in the Presence of Water and Water Vapor. (revises Aug. 16, 2013) Fibre Box Association (FBA), Elk Grove Village, IL, 1-23, Retrieved from http://www.corrugated.org/wp-content/uploads/PDFs/Recycling/Vol_Std_Protocol_2013. pdf.
Collison, Alan B.; Applicant Interview Summary for U.S. Appl. No. 15/677,738, filed Aug. 15, 2017, dated Apr. 22, 2019, 4 pgs.
Collison, Alan B.; Final Office ACtion for U.S. Appl. No. 15/677,738, filed Aug. 15, 2017, dated Feb. 28, 2019, 14 pgs.
Collison, Alan B.; Applicant Interview Summary for U.S. Appl. No. 15/677,738, filed Aug. 15, 2017, dated Dec. 5, 2018, 4 pgs.
Collison, Alan B.; Non-Final Office Action for U.S. Appl. No. 15/677,738, filed Aug. 15, 2017, dated Oct. 23, 2018, 11 pgs.
Collison, Alan B.; Requirement for Restriction/Election for U.S. Appl. No. 15/677,738, filed Aug. 15, 2017, dated Jul. 31, 2018, 8 pgs.
Collison, Alan B.; Requirement for Restriction/Election for U.S. Appl. No. 15/677,738, filed Aug. 15, 2017, dated Jul. 3, 2018, 8 pgs.

(56) References Cited

OTHER PUBLICATIONS

MP Global Products, LLC; International Search Report and Written Opinion of the International Searching Authority for PCT/US2017/060403, filed Nov. 7, 2017, dated Feb. 19, 2018, 15 pgs.
Collison, Alan B.; Applicant Interview Summary for U.S. Appl. No. 16/658,756, filed Oct. 21, 2019, dated Jun. 29, 2020, 3 pgs.
Collison, Alan B.; Final Office Action for U.S. Appl. No. 16/658,756, filed Oct. 21, 2019, dated Jun. 17, 2020, 10 pgs.
Collison, Alan B.; Applicant Interview Summary for U.S. Appl. No. 16/658,756, filed Oct. 21, 2019, dated May 6, 2020, 3 pgs.
MP Global Products LLC: European Search Report for serial No. 17868605.1, dated Mar. 16, 2020, 7 pgs.
Collison, Alan B.; Non-Final Office Action for U.S. Appl. No. 16/658,756, filed Oct. 21, 2019, dated Feb. 4, 2020, 14 pgs.
Collison, Alan B.; Non-Final Office Action for U.S. Appl. No. 16/414,309, filed May 16, 2019, dated Jul. 17, 2020, 77 pgs.
Collison, Alan B.; Requirement for Restriction/Election for U.S. Appl. No. 16/414,309, filed May 16, 2019, dated Jun. 16, 2020, 5 pgs.
Collison, Alan B.; Applicant-Initiated Interview Summary for U.S. Appl. No. 16/414,310, filed May 16, 2019, dated Jul. 30, 2020, 3 pgs.
Collison, Alan B.; Non-Final Office Action for U.S. Appl. No. 16/414,310, filed May 16, 2019, dated Jul. 8, 2020, 84 pgs.
Sollie, Greg; Non-Final Office Action for U.S. Appl. No. 15/988,550, filed May 24, 2018, dated Mar. 11, 2020, 35 pgs.
Sollie, Greg; Applicant Initiated Interview Summary for U.S. Appl. No. 15/988,550, filed May 24, 2018, dated Dec. 27, 2019, 3 pgs.
Sollie, Greg; Non-Final Office Action for U.S. Appl. No. 15/988,550, filed May 24, 2018, dated Oct. 9, 2019, 17 pgs.
Sollie, Greg; Final Office Action for U.S. Appl. No. 15/988,550, filed May 24, 2018, dated Aug. 14, 2019, 19 pgs.
Sollie, Greg; Non-Final Office Action for U.S. Appl. No. 15/988,550, filed May 24, 2018, dated May 29, 2019, 48 pgs.
Cold Keepers; Article entitled: "Insulated Shipping Boxes—Coldkeepers, Thermal Shipping Solutions", located at <https://www.coldkeepers.com/product-category/shipping/>, (Accessed: Jan. 12, 2017), 3 pgs.
Needles 'N' Knowledge; Article entitled: "Tall Box With Lid", located at <http://needlesnknowledge.blogspot.com/2017/10/tall-box-with-lid.html> (Accessed: Jan. 12, 2017), 10 pgs.
Sollie, Greg; Advisory Action for U.S. Appl. No. 16/280,595, filed Feb. 20, 2019, dated Jul. 6, 2020, 3 pgs.
Sollie, Greg; Applicant-Initiated Interview Summary for U.S. Appl. No. 16/280,595, filed Feb. 20, 2019 dated May 6, 2020, 3 pgs.
Sollie, Greg; Final Office Action for U.S. Appl. No. 16/280,595, filed Feb. 20, 2019, dated Mar. 24, 2020, 20 pgs.
Sollie, Greg; Non-Final Office Action for U.S. Appl. No. 16/280,595, filed Feb. 20, 2019, dated Dec. 19, 2019, 23 pgs.
Sollie, Greg; Final Office Action for U.S. Appl. No. 16/280,595, filed Feb. 20, 2019, dated Oct. 3, 2019, 19 pgs.
Sollie, Greg; Non-Final Office Action for U.S. Appl. No. 16/280,595, filed Feb. 20, 2019, dated May 29, 2019, 60 pgs.
Sollie, Greg; Non-Final Office Action for U.S. Appl. No. 16/530,052, filed Aug. 2, 2019, dated Mar. 3, 2020, 24 pgs.
Sollie, Greg; Applicant-Initiated Interview Summary for U.S. Appl. No. 16/530,052, filed Aug. 2, 2019, dated Feb. 5, 2020, 2 pgs.
Sollie, Greg; Final Office Action for U.S. Appl. No. 16/530,052, filed Aug. 2, 2019, dated Dec. 27, 2019, 49 pgs.
Sollie, Greg; Non-Final Office Action for U.S. Appl. No. 16/530,052, filed Aug. 2, 2019, dated Oct. 2, 2019, 12 pgs.
Sollie, Greg; Final Office Action for U.S. Appl. No. 16/401,603, filed May 2, 2019, dated Jun. 30, 2020, 13 pgs.
Sollie, Greg; Applicant-Initiated Interview Summary for U.S. Appl. No. 16/401,603, filed May 2, 2019, dated May 15, 2020, 3 pgs.
Sollie, Greg; Non-Final Office Action for U.S. Appl. No. 16/401,603, filed May 2, 2019, dated Mar. 10, 2020, 67 pgs.
Sollie, Greg; Requirement for Restriction/Election for U.S. Appl. No. 16/401,603, filed May 2, 2019, dated Feb. 18, 2020, 6 pgs.
Cellulose Material Solutions, LLC; Brochure for Infinity Care Thermal Liner, accessed on Oct. 22, 2018, 2 pgs.
Uline; Article entitled: Corrugated Corner Protectors —4 x 4", accessed on Oct. 25, 2018, 1 pg.
Sollie, Greg; Notice of Allowance for U.S. Appl. No. 16/382,710, filed Apr. 12, 2019, dated Jun. 3, 2020, 12 pgs.
Sollie, Greg; Final Office Action for U.S. Appl. No. 16/382,710, filed Apr. 12, 2019, dated Apr. 6, 2020, 33 pgs.
Sollie, Greg; Non-Final Office Action for U.S. Appl. No. 16/382,710, filed Apr. 12, 2019, dated Oct. 10, 2019, 49 pgs.
Sollie, Greg; Requirement for Restriction/Election for U.S. Appl. No. 16/382,710, filed Apr. 12, 2019, dated Jul. 15, 2019, 6 pgs.
DHL Express; Brochure for Dry Ice Shipping Guidelines, accessed on Oct. 26, 2018, 12 pgs.
Sollie, Greg; Notice of Allowance for U.S. Appl. No. 16/567,192, filed Sep. 11, 2019, dated Aug. 7, 2020, 14 pgs.
Sollie, Greg; Final Office Action for U.S. Appl. No. 16/567,192, filed Sep. 11, 2019, dated Jun. 8, 2020, 20 pgs.
Sollie, Greg; Non-Final Office Action for U.S. Appl. No. 16/567,192, filed Sep. 11, 2019, dated Dec. 10, 2019, 49 pgs.
Thomas Scientific; Article entitled: "Thermosafe: Test Tube Shipper/Rack", accessed on Oct. 26, 2018, 2 pgs.
Stinson, Elizabeth; Article entitled: "A Pizza Geek Discovers the World's Smartest Pizza Box", published Jan. 17, 2014, 8 pgs.
Sollie, Greg; Final Office Action for U.S. Appl. No. 16/408,981, filed May 10, 2019, dated Feb. 24, 2020, 29 pgs.
Sollie, Greg; Non-Final Office Action for U.S. Appl. No. 16/408,981, filed May 10, 2019, dated Aug. 20, 2019, 50 pgs.
Waltermire, Jamie; International Search Report and Written Opinion for PCT Application No. PCT/US18/65464, filed Dec. 13, 2018, dated Mar. 11, 2019, 9 pgs.
Sollie, Greg; International Preliminary Report on Patentability for PCT Application No. PCT/US18/65459, filed Dec. 13, 2018, dated Jul. 2, 2020, 11 pgs.
Sollie, Greg; International Search Report and Written Opinion for PCT Application No. PCT/US18/65459, filed Dec. 13, 2018, dated May 1, 2019, 15 pgs.
Sollie, Greg; International Preliminary Report on Patentability for PCT Application No. PCT/US18/65461, filed Dec. 13, 2018, dated Jul. 2, 2020, 12 pgs.
Sollie, Greg; International Search Report and Written Opinion for PCT Application No. PCT/US18/65461, filed Dec. 13, 2018, dated Mar. 21, 2019, 13 pgs.
Sollie, Greg; International Search Report and Written Opinion for PCT/US18/65463, filed Dec. 13, 2018, dated Mar. 25, 2019, 11 pgs.
Sollie, Greg; International Search Report and Written Opinion for PCT Application No. PCT/US20/24820, filed Mar. 26, 2020, dated Jul. 2, 2020, 14 pgs.
Sollie, Greg; International Search Report and Written Opinion for PCT Application No. PCT/US19/60486, filed Nov. 18, 2019, dated Jan. 13, 2020, 10 pgs.
Sollie, Greg; International Search Report and Written Opinion for PCT Application No. PCT/US19/59764, filed Nov. 5, 2019, dated Jul. 1, 2020, 13 pgs.
Sollie, Greg; Invitation to Pay Additional Fees for PCT/US19/59764, filed Nov. 5, 2019, dated Jan. 2, 2020, 2 pgs.
Waltermire, Jamie; Corrected Notice of Allowance for U.S. Appl. No. 16/526,511, filed Jul. 30, 2019, dated Nov. 30, 2020, 9 pgs.
Waltermire, Jamie; Final Office Action for U.S. Appl. No. 16/530,045, filed Aug. 2, 2019, dated Nov. 24, 2020, 40 pgs.
Waltermire, Jamie; Non-Final Office Action for U.S. Appl. No. 16/164,933, filed Oct. 19, 2018, dated Nov. 18, 2020, 104 pgs.
Waltermire, Jamie; Corrected Notice of Allowance for U.S. Appl. No. 15/590,349, filed May 9, 2017, dated Dec. 22, 2020, 9 pgs.
Waltermire, Jamie; Corrected Notice of Allowance for U.S. Appl. No. 16/561,203, filed Sep. 5, 2019, dated Jan. 5, 2021, 9 pgs.
Sollie, Greg; Corrected Notice of Allowance for U.S. Appl. No. 16/552,277, filed Aug. 27, 2019, dated Dec. 22, 2020, 7 pgs.
Solie, Greg; Corrected Notice of Allowance for U.S. Appl. No. 15/845,540, filed Dec. 18, 2017, dated Dec. 21, 2020, 9 pgs.
Collison, Alan B.; Corrected Notice of Allowance for U.S. Appl. No. 16/414,309, filed May 16, 2019, dated Nov. 16, 2020, 10 pgs.

(56) References Cited

OTHER PUBLICATIONS

Collison, Alan B.; Corrected Notice of Allowance for U.S. Appl. No. 16/414,309, filed May 16, 2019, dated Nov. 27, 2020, 9 pgs.
Collison, Alan B.; Notice of Allowance for U.S. Appl. No. 16/414,310, filed May 16, 2019, dated Nov. 13, 2020, 15 pgs.
Collison, Alan B.; Supplemental Notice of Allowance for U.S. Appl. No. 16/414,310, filed May 16, 2019, dated Dec. 3, 2020, 8 pgs.
Sollie, Greg; Applicant-Initiated Interview Summary for U.S. Appl. No. 15/988/550, filed May 24, 2018, dated Dec. 24, 2020, 2 pgs.
Sollie, Greg; Final Office Action for U.S. Appl. No. 16/280,595, filed Feb. 20, 2019, dated Dec. 30, 2020, 25 pgs.
Sollie, Greg; Non-Final Office Action for U.S. Appl. No. 16/530,052, filed Aug. 2, 2019, dated Dec. 18, 2020, 17 pgs.
Sollie, Greg; Corrected Notice of Allowance for U.S. Appl. No. 16/401,603, filed May 2, 2019, dated Nov. 24, 2020, 8 pgs.
Sollie, Greg; Corrected Notice of Allowance for U.S. Appl. No. 16/401,607, filed May 2, 2019, dated Jan. 4, 2021, 9 pgs.
Sollie, Greg; Notice of Allowance for U.S. Appl. No. 16/401,607, filed May 2, 2019, dated Dec. 4, 2020, 12 pgs.
Sollie, Greg; Final Office Action for U.S. Appl. No. 16/408,981, filed May 10, 2019, dated Dec. 29, 2020, 22 pgs.
Sollie, Greg; Requirement for Restriction/Election for U.S. Appl. No. 16/886,040, filed May 28, 2020, dated Dec. 23, 2020, 6 pgs.
Sollie, Greg; International Preliminary Report on Patentability for PCT/US18/65463, filed Dec. 13, 2018, dated Dec. 3, 2020, 9 pgs.
Waltermire, Jamie; Corrected Notice of Allowance for U.S. Appl. No. 15/482,186, filed Apr. 7, 2017, dated Jun. 2, 2020, 10 pgs.
Waltermire, Jamie; Non-Final Office Action for U.S. Appl. No. 15/482,186, filed Apr. 7, 2017, dated Aug. 20, 2019, 81 pgs.
Waltermire, Jamie; Notice of Allowance for U.S. Appl. No. 15/482,186, filed Apr. 7, 2017, dated Mar. 5, 2020, 29 pgs.
Waltermire, Jamie; Requirement for Restriction/Election for U.S. Appl. No. 15/482,186, filed Apr. 7, 2017, dated Apr. 17, 2019, 7 pgs.
Waltermire, Jamie; Applicant-Initiated Interview Summary for U.S. Appl. No. 16/526,511, filed Jul. 30, 2019, dated Jun. 12, 2020, 5 pgs.
Waltermire, Jamie; Final Office Action for U.S. Appl. No. 16/526,511, filed Jul. 30, 2019, dated May 19, 2020, 39 pgs.
Waltermire, Jamie; Non-Final Office Action for U.S. Appl. No. 16/526,511, filed Jul. 30, 2019, dated Dec. 9, 2019, 55 pgs.
Waltermire, Jamie; Non-Final Office Action for U.S. Appl. No. 16/526,511, filed Jul. 30, 2019, dated Jul. 10, 2020, 23 pgs.
Waltermire, Jamie; Final Office Action for U.S. Appl. No. 15/482,200, filed Apr. 7, 2017, dated Jan. 2, 2019, 23 pgs.
Waltermire, Jamie; Non-Final Office Action for U.S. Appl. No. 15/482,200, filed Apr. 7, 2017, dated Jun. 11, 2018, 36 pgs.
Waltermire, Jamie; Notice of Allowance for U.S. Appl. No. 15/482,200, filed Apr. 7, 2017, dated May 14, 2019, 25 pgs.
Waltermire, Jamie; Supplemental Notice of Allowance for U.S. Appl. No. 15/482,200, filed Apr. 7, 2017, dated Jul. 26, 2019, 9 pgs.
Waltermire, Jamie; Supplemental Notice of Allowance for U.S. Appl. No. 15/482,200, filed Apr. 7, 2017, dated Aug. 12, 2019, 7 pgs.
Waltermire, Jamie; Supplemental Notice of Allowance for U.S. Appl. No. 15/482,200, filed Apr. 7, 2017, dated Sep. 10, 2019, 8 pgs.
Waltermire, Jamie; Applicant-Initiated Interview Summary for U.S. Appl. No. 16/530,045, filed Aug. 2, 2019, dated Jun. 15, 2020, 3 pgs.
Waltermire, Jamie; Non-Final Office Action for U.S. Appl. No. 16/530,045, filed Aug. 2, 2019, dated Dec. 20, 2019, 61 pgs.
Waltermire, Jamie; Non-Final Office Action for U.S. Appl. No. 16/530,045, filed Aug. 2, 2019, dated May 27, 2020, 38 pgs.
Waltermire, Jamie; Corrected Notice of Allowance for U.S. Appl. No. 15/590,345, filed May 9, 2017, dated Feb. 18, 2020, 9 pgs.
Waltermire, Jamie; Final Office Action for U.S. Appl. No. 15/590,345, filed May 9, 2017, dated Mar. 19, 2019, 42 pgs.
Waltermire, Jamie; Non-Final Office Action for U.S. Appl. No. 15/590,345, filed May 9, 2017, dated Aug. 24, 2018, 41 pgs.
Waltermire, Jamie; Notice of Allowance for U.S. Appl. No. 15/590,345, filed May 9, 2017, dated Oct. 1, 2019, 28 pgs.
Waltermire, Jamie; Supplemental Notice of Allowance for U.S. Appl. No. 15/590,345, filed May 9, 2017, dated Jan. 9, 2020, 8 pgs.
Waltermire, Jamie; Supplemental Notice of Allowance for U.S. Appl. No. 15/590,345, filed May 9, 2017, dated Dec. 3, 2019, 14 pgs.
Waltermire, Jamie; Applicant-Initiated Interview Summary for U.S. Appl. No. 15/590,349, filed May 9, 2017, dated Dec. 3, 2019, 3 pgs.
Waltermire, Jamie; Final Office Action for U.S. Appl. No. 15/590,349, filed May 9, 2017, dated Jan. 6, 2020, 26 pgs.
Waltermire, Jamie; Final Office Action for U.S. Appl. No. 15/590,349, filed May 9, 2017, dated May 9, 2019, 31 pgs.
Waltermire, Jamie; Non-Final Office Action for U.S. Appl. No. 15/590,349, filed May 9, 2017, dated Nov. 5, 2018, 41 pgs.
Waltermire, Jamie; Non-Final Office Action for U.S. Appl. No. 15/590,349, filed May 9, 2017, dated Jun. 12, 2020, 30 pgs.
Waltermire, Jamie; Non-Final Office Action for U.S. Appl. No. 15/590,349, filed May 9, 2017, dated Sep. 5, 2019, 25 pgs.
Waltermire, Jamie; Requirement for Restriction/Election for U.S. Appl. No. 15/590,349, filed May 9, 2017, dated Aug. 30, 2018, 10 pgs.
Waltermire, Jamie; Non-Final Office Action for U.S. Appl. No. 16/293,716, filed Mar. 6, 2019, dated May 5, 2020, 70 pgs.
Waltermire, Jamie; Requirement for Restriction/Election for U.S. Appl. No. 16/293,716, filed Mar. 6, 2019, dated Feb. 26, 2020, 6 pgs.
Waltermire, Jamie; Non-Final Office Action for U.S. Appl. No. 16/526,555, filed Jul. 30, 2019, dated Apr. 2, 2020, 63 pgs.
Waltermire, Jamie; Requirement for Restriction/Election for U.S. Appl. No. 16/526,555, filed Jul. 30, 2019, dated Jan. 17, 2020, 7 pgs.
Waltermire, Jamie; Corrected Notice of Allowance for U.S. Appl. No. 15/663,905, filed Jul. 31, 2017, dated Nov. 18, 2019, 6 pgs.
Waltermire, Jamie; Corrected Notice of Allowance for U.S. Appl. No. 15/663,905, filed Jul. 31, 2017, dated Dec. 26, 2019, 7 pgs.
Waltermire, Jamie; Final Office Action for U.S. Appl. No. 15/663,905, filed Jul. 31, 2017, dated Aug. 22, 2019, 23 pgs.
Waltermire, Jamie; Non-Final Office Action for U.S. Appl. No. 15/663,905, filed Jul. 31, 2017, dated Jun. 25, 2019, 66 pgs.
Waltermire, Jamie; Notice of Allowance for U.S. Appl. No. 15/663,905, filed Jul. 31, 2017, dated Nov. 4, 2019, 18 pgs.
Waltermire, Jamie; Requirement for Restriction/Election for U.S. Appl. No. 15/663,905, filed Jul. 31, 2017, dated Mar. 21, 2019, 8 pgs.
Waltermire, Jamie; Advisory Action for U.S. Appl. No. 16/381,678, filed Apr. 11, 2019, dated Feb. 26, 2020, 3 pgs.
Waltermire, Jamie; Final Office Action for U.S. Appl. No. 16/381,678, filed Apr. 11, 2019, dated Dec. 30, 2019, 17 pgs.
Waltermire, Jamie; Final Office Action for U.S. Appl. No. 16/381,678, filed Apr. 11, 2019, dated Jun. 16, 2020, 8 pgs.
Waltermire, Jamie; Non-Final Office Action for U.S. Appl. No. 16/381,678, filed Apr. 11, 2019, dated Apr. 17, 2020, 30 pgs.
Waltermire, Jamie; Non-Final Office Action for U.S. Appl. No. 16/381,678, filed Apr. 11, 2019, dated Sep. 9, 2019, 50 pgs.
Waltermire, Jamie; Notice of Allowance for U.S. Appl. No. 16/381,678, filed Apr. 11, 2019, dated Jan. 30, 2020, 15 pgs.
Waltermire, Jamie; Non-Final Office Action for U.S. Appl. No. 16/561,203, filed Sep. 5, 2019, dated May 6, 2020, 59 pgs.
Waltermire, Jamie; Requirement for Restriction/Election for U.S. Appl. No. 16/561,203, filed Sep. 5, 2019, dated Feb. 26, 2020, 5 pgs.
Sollie, Greg; Corrected Notice of Allowance for U.S. Appl. No. 15/845,545, filed Dec. 18, 2017, dated Oct. 1, 2019, 7 pgs.
Sollie, Greg; Corrected Notice of Allowance for U.S. Appl. No. 15/845,545, filed Dec. 18, 2017, dated Oct. 31, 2019, 12 pgs.
Waltermire, Jamie; Supplemental Notice of Allowance for U.S. Appl. No. 16/164,933, filed Oct. 19, 2018, dated May 26, 2021, 10 pgs.
Waltermire, Jamie; Supplemental Notice of Allowance for U.S. Appl. No. 16/164,933, filed Oct. 19, 2018, dated Jun. 16, 2021, 7 pgs.
Waltermire, Jamie; Certificate of Correction for U.S. Appl. No. 15/590,349, filed May 9, 2017, dated Jun. 1, 2021, 1 pg.
Waltermire, Jamie; Non-Final Office Action for U.S. Appl. No. 16/293,716, filed Mar. 6, 2019, dated Jul. 26, 2021, 26 pgs.

(56) References Cited

OTHER PUBLICATIONS

Waltermire, Jamie; Notice of Allowance for U.S. Appl. No. 16/526,555, filed Jul. 30, 2019, dated Jun. 21, 2021, 32 pgs.
Waltermire, Jamie; Supplemental Notice of Allowance for U.S. Appl. No. 16/526,555, filed Jul. 30, 2019, dated Jun. 8, 2021, 13 pgs.
Waltermire, Jamie; Supplemental Notice of Allowance for U.S. Appl. No. 16/526,555, filed Jul. 30, 2019, dated Jul. 6, 2021, 7 pgs.
Waltermire, Jamie; Notice of Allowance for U.S. Appl. No. 16/381,678, filed Apr. 11, 2019, dated Jun. 3, 2021, 14 pgs.
Waltermire, Jamie; Notice of Allowance for U.S. Appl. No. 16/689,407, filed Nov. 20, 2019, dated Jul. 19, 2021, 12 pgs.
Sollie, Greg; Certificate of Correction for U.S. Appl. No. 15/845,540, filed Dec. 18, 2017, dated Jun. 1, 2021, 1 pg.
Collison, Alan B.; Applicant-Initiated Interview Summary for U.S. Appl. No. 17/123,673, filed Dec. 16, 2020, dated Jun. 24, 2021, 2 pgs.
Collison, Alan B.; Notice of Allowance for U.S. Appl. No. 17/123,673, filed Dec. 16, 2020, dated Jul. 1, 2021, 12 pgs.
Collison, Alan B.; Supplemental Notice of Allowance for U.S. Appl. No. 17/123,676, filed Dec. 16, 2020, dated Jun. 1, 2021, 10 pgs.
Collison, Alan B.; Supplemental Notice of Allowance for U.S. Appl. No. 17/123,676, filed Dec. 16, 2020, dated Jun. 24, 2021, 7 pgs.
Sollie, Greg; Corrected Notice of Allowance for U.S. Appl. No. 15/988,550, filed May 24, 2018, dated May 11, 2021, 7 pgs.
Sollie, Greg; Advisory Action for U.S. Appl. No. 16/530,052, filed Aug. 2, 2019, dated Jun. 29, 2021, 15 pgs.
Sollie, Greg; Corrected Notice of Allowance for U.S. Appl. No. 16/408,981, filed May 10, 2019, dated Jun. 16, 2021, 9 pgs.
Sollie, Greg; Notice of Allowance for U.S. Appl. No. 16/886,040, filed May 28, 2020, dated Jul. 7, 2021, 12 pgs.
Waltermire, Jamie; International Preliminary Report on Patentability for PCT Application No. PCT/US18/65464, filed Dec. 13, 2018, dated Jun. 24, 2021, 8 pgs.
Sollie, Greg; International Preliminary Report on Patentability for PCT Application No. PCT/US19/60486, filed Nov. 18, 2019, dated May 27, 2021, 9 pgs.
Sollie, Greg; International Preliminary Report on Patentability for PCT Application No. PCT/US19/59764, filed Nov. 5, 2019, dated May 27, 2021, 9 pgs.
Waltermire, Jamie; Non-Final Office Action for U.S. Appl. No. 17/079,437, filed Oct. 24, 2020, dated Sep. 20, 2021, 108 pgs.
Waltermire, Jamie; Notice of Allowance for U.S. Appl. No. 16/164,933, filed Oct. 19, 2018, dated Aug. 9, 2021, 10 pgs.
Waltermire, Jamie; Requirement for Restriction/Election for U.S. Appl. No. 16/721,995, filed Dec. 20, 2019, dated Aug. 13, 2021, 6 pgs.
Waltermire, Jamie; Supplemental Notice of Allowance for U.S. Appl. No. 16/526,555, filed Jul. 30, 2019, dated Aug. 11, 2021, 8 pgs.
Waltermire, Jamie; Corrected Notice of Allowance for U.S. Appl. No. 16/381,678, filed Apr. 11, 2019, dated Aug. 9, 2021, 8 pgs.
Waltermire, Jamie; Examiner-Initiated Interview Summary for U.S. Appl. No. 16/381,678, filed Apr. 11, 2019, dated Aug. 30, 2021, 2 pgs.
Waltermire, Jamie; Corrected Notice of Allowance for U.S. Appl. No. 16/689,407, filed Nov. 20, 2019, dated Aug. 20, 2021, 9 pgs.
Waltermire, Jamie; Final Office Action for U.S. Appl. No. 16/689,433, filed Nov. 20, 2019, dated Aug. 5, 2021, 23 pgs.
Collison, Alan B.; Corrected Notice of Allowance for U.S. Appl. No. 17/123,673, filed Dec. 16, 2020, dated Aug. 23, 2021, 9 pgs.
Collison, Alan B.; Supplemental Notice of Allowance for U.S. Appl. No. 17/123,676, filed Dec. 16, 2020, dated Sep. 13, 2021, 10 pgs.
Sollie, Greg; Final Office Action for U.S. Appl. No. 16/280,595, filed Feb. 20, 2019, dated Aug. 16, 2021, 21 pgs.
Sollie, Greg; Non-Final Office Action for U.S. Appl. No. 16/530,052, filed Aug. 2, 2019, dated Aug. 13, 2021, 22 pgs.
Sollie, Greg; Non-Final Office Action for U.S. Appl. No. 17/078,884, filed Oct. 23, 2020, dated Aug. 12, 2021, 105 pgs.
Sollie, Greg; Non-Final Office Action for U.S. Appl. No. 17/078,891, filed Oct. 23, 2020, dated Aug. 23, 2021, 104 pgs.
Sollie, Greg; Non-Final Office Action for U.S. Appl. No. 17/187,239, filed Feb. 26, 2021, dated Sep. 21, 2021, 99 pgs.
Sollie, Greg; Non-Final Office Action for U.S. Appl. No. 17/185,616, filed Feb. 25, 2021, dated Sep. 15, 2021, 103 pgs.
Sollie, Greg; Corrected Notice of Allowance for U.S. Appl. No. 16/886,040, filed May 28, 2020, dated Aug. 20, 2021, 9 pgs.
Carlson, Dave; Article entitled: "FBA Updates Voluntary Standard For Recyclable Wax Alternatives", dated Aug. 14, 2013, Fiber Box Association (Year: 2013), 2 pgs.
Sollie, Greg; Non-Final Office Action for U.S. Appl. No. 17/100,819, filed Nov. 21, 2020, dated Sep. 29, 2021, 107 pgs.
Waltermire, Jamie; Notice of Allowance for U.S. Appl. No. 16/293,716, filed Mar. 6, 2019, dated Nov. 3, 2021, 20 pgs.
Waltermire, Jamie; Corrected Notice of Allowance for U.S. Appl. No. 16/689,407, filed Nov. 20, 2019, dated Oct. 20, 2021, 8 pgs.
Waltermire, Jamie: Notice of Allowance for U.S. Appl. No. 16/689,433, filed Nov. 20, 2019, dated Oct. 15, 2021, 14 pgs.
Collison, Alan B.; Non-Final Office Action for U.S. Appl. No. 17/181,377, filed Feb. 22, 2021, dated Jul. 1, 2021, 22 pgs.
Collison, Alan B.; Notice of Allowance for U.S. Appl. No. 17/181,377, filed Feb. 22, 2021, dated Oct. 21, 2021, 6 pgs.
Collison, Alan B.; Restriction Requirement for U.S. Appl. No. 17/181,377, filed Feb. 22, 2021, dated Apr. 22. 2021, 6 pgs.
Collison, Alan B.; Corrected Notice of Allowance for U.S. Appl. No. 17/123,376, filed Dec. 16, 2020, dated Oct. 6, 2021, 8 pgs.
Sollie, Greg; Applicant-Initiated Interview Summary for U.S. Appl. No. 17/078,891, filed Oct. 23, 2020, dated Oct. 25, 2021, 2 pgs.
Sollie, Greg; Notice of Allowance for U.S. Appl. No. 17/187,239, filed Feb. 26, 2021, dated Oct. 13, 2021, 5 pgs.
Sollie, Greg; Corrected Notice of Allowance for U.S. Appl. No. 16/886,040, filed May 28, 2020, dated Oct. 7, 2021, 8 pgs.

* cited by examiner

INSULATED BOX ASSEMBLY WITH OVERLAPPING PANELS

CROSS-REFERENCE TO RELATED APPLICATIONS

This application is a continuation of U.S. patent application Ser. No. 16/382,710, filed Apr. 12, 2019, which claims the benefit of U.S. Provisional Application No. 62/760,672, filed on Nov. 13, 2018, which are both hereby incorporated by reference herein in their entireties.

JOINT RESEARCH AGREEMENT

The subject matter disclosed was developed and the claimed invention was made by, or on behalf of, one or more parties to a joint research agreement between MP Global Products LLC of Norfolk, Nebr. and Pratt Retail Specialties, LLC of Conyers, Ga., that was in effect on or before the effective filing date of the claimed invention, and the claimed invention was made as a result of activities undertaken within the scope of the joint research agreement.

TECHNICAL FIELD

This disclosure relates to foldable boxes. More specifically, this disclosure relates to insulated foldable boxes.

BACKGROUND

Home delivery of food is becoming more common as the process becomes more efficient and costs go down. Delivery boxes may alternatively need to keep the food hot or cold enough to, for example, prevent bacterial growth, prevent melting or congealing of the food, or simply maintain the edibility, texture, and flavor of the food. Another consideration for the type of box to use is its impact on the environment, as it relates to the reusability and recyclability of the boxes. Polystyrene foam boxes are prevalent in the food-delivery industry because of their low cost, but they are not commonly recycled. Thus, they take up a disproportionate volume of landfill space.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts off the disclosure as an introduction to the following complete and extensive detailed description.

Disclosed is a a box assembly comprising an exterior piece comprising a middle portion; a connecting segment coupled to the middle portion by a fold line; and a end segment coupled to the connecting segment by a fold line, the connecting segment positioned substantially perpendicular to the middle portion and the end segment; an interior piece positioned within the exterior piece, the interior piece comprising a side panel, a space defined between the middle portion and the side panel, the interior piece defining a cavity, the end segment extending into the cavity, the end segment coupled to the side panel; and an insulator positioned at least partially within the space.

Also disclosed is a method of assembling a box assembly comprising folding a lower portion of an exterior piece about a fold line relative to a middle portion of the exterior piece; folding a side panel of an interior piece about a fold line relative to a bottom panel of the interior piece; positioning an insulator within the exterior piece; positioning the interior piece within the exterior piece comprising positioning the bottom panel over the lower portion; and forming a space between the middle portion and the side panel, the insulator at least partially positioned within the space; folding a connecting segment of the exterior piece about a fold line relative to the middle portion to at least partially cover the space; inserting an end segment of the exterior piece into a cavity defined by the interior piece, the end segment coupled to the connecting segment by a fold line; and coupling the end segment to the side panel.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
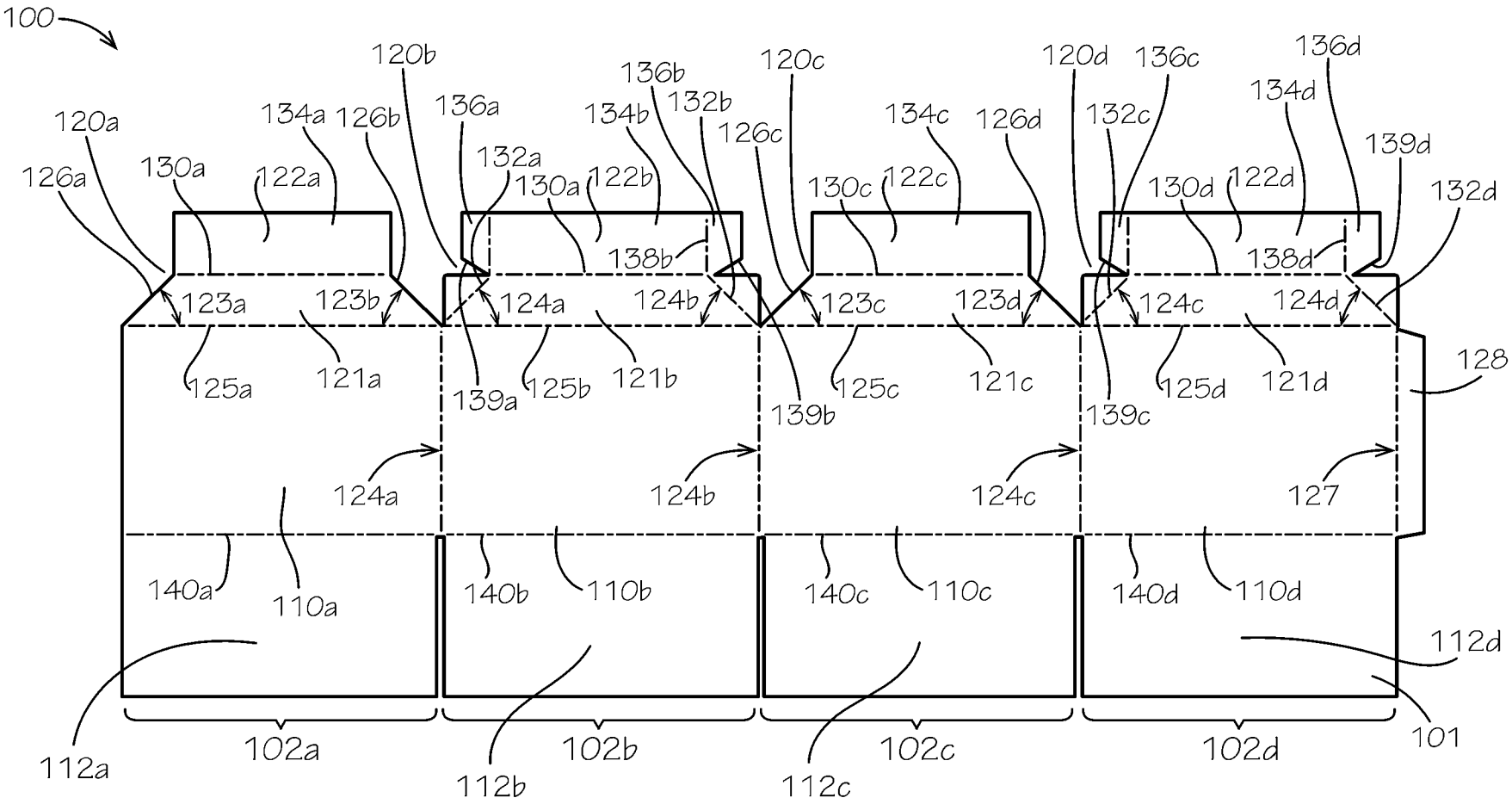
FIG. 1 shows a blank configured to be assembled into an exterior piece of an insulated box in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

FIG. 1 shows in one exemplary aspect an exterior piece 100 of an insulated box 2400 (shown in FIG. 25) in an unassembled configuration as a blank. As shown, the exterior piece 100 can comprise four subpanels 102*a,b,c,d*. Each subpanel can comprise a middle portion 110*a,b,c,d*, an upper portion 120*a,b,c,d*, and a lower portion 112*a,b,c,d*. The middle portions 110*a,b,c,d* can be joined by fold lines 124*a,b,c*. A side strip 128 can be joined to the fourth middle portion 110*d* by a fold line 127. The exterior piece 100 as a blank can define a planar first exterior surface 101, with a similar planar second exterior surface (not shown) opposite from the exterior surface 101.

Each middle portion 110*a,b,c,d* can be joined to an upper portion 120*a,b,c,d* by a fold line 125*a,b,c,d*. Each upper portion can comprise a connecting segment 121*a,b,c,d* and an end segment 122*a,b,c,d*. The end segments 122*a,b,c,d* can be joined to the connecting segments 121*a,b,c,d* by fold lines 130*a,b,c,d*.

The connecting segments 121*a,c* can be of various shapes, including rectangles, parallelograms, and trapezoids. In the current aspect, a first connecting segment 121*a* and a third connecting segment 121*c* can be trapezoidal in shape. The legs 126*a,b,c,d* of the first and third connecting segments 121*a,c* can form angles 123*a,b,c,d* with the fold lines 125*a,b,c,d*. The angles 123*a,b,c,d* can be about 45 degrees. A second and a fourth connecting segment 121*b,d* can be substantially rectangular and can comprise or define crease lines 132*a,b,c,d*.

Each end segment 122*a,b,c,d* can comprise a middle tab 134*a,b,c,d* and a side tab 136*a,b,c,d*. In the current aspect, the second and fourth end segments 122*b,d* can each comprise two side tabs 136*a,b,c,d*. The side tabs 136*a,b,c,d* can be joined to the middle tabs 134*a,b,c,d* by fold lines 138*a,b,c,d*. Each side tab can comprise a bottom edge 139*a,b,c,d*, and each bottom edge 139*a,b,c,d* can form an angle with the fold lines 138*a,b,c,d*. The lower portions 112*a,b,c,d* can be joined to the middle portions 110*a,b,c,d* by fold lines 140*a,b,c,d*.

Figure 2:
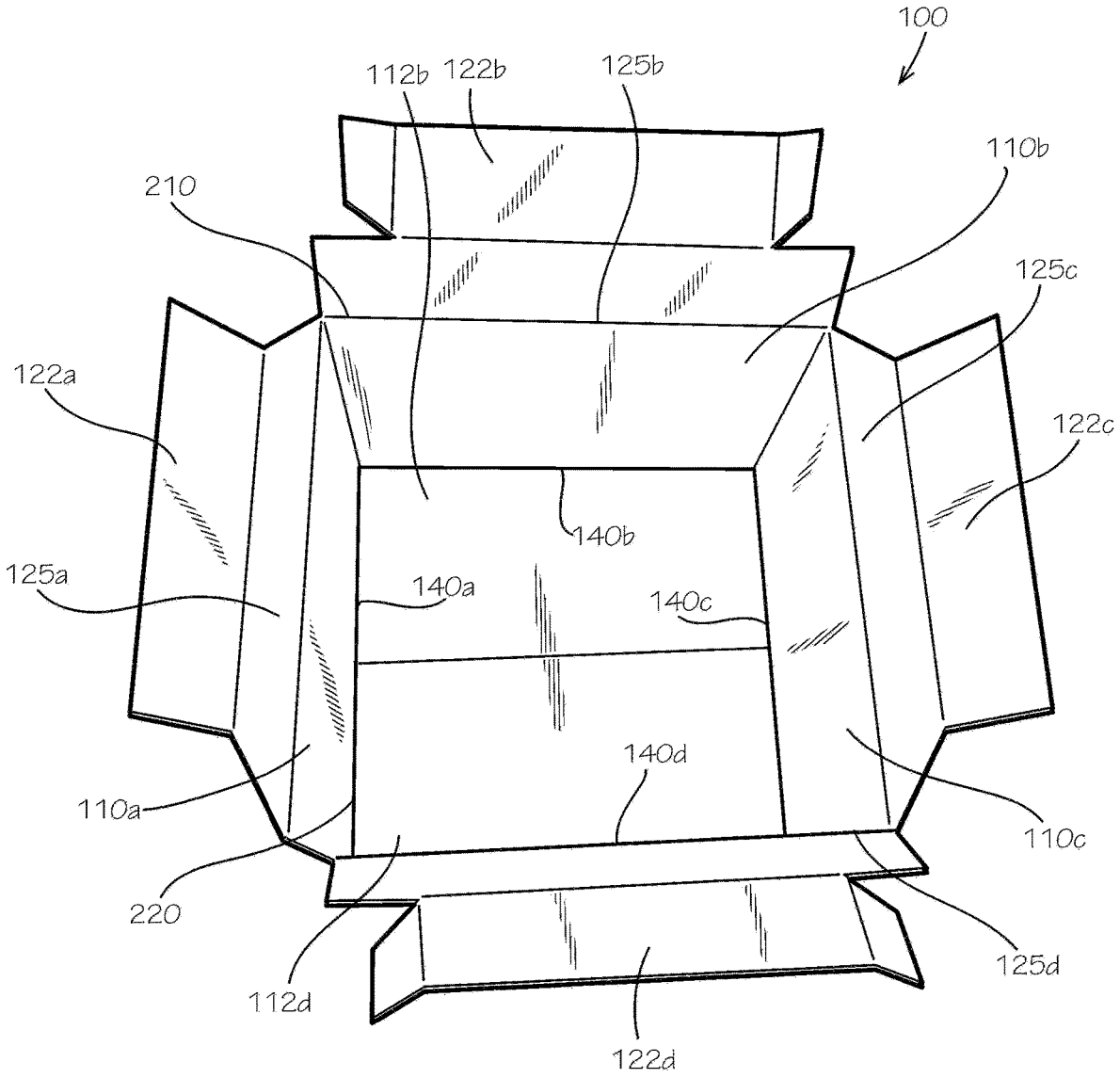
FIG. 2 is a perspective view of the exterior piece of the insulated box assembled from the blank of FIG. 1.

FIG. 2 is a perspective view of the exterior piece 100 in an assembled configuration. The fold lines 140*a,b,c,d* joining the middle portions 110*a,b,c,d* to the upper portions 120*a,b,c,d* can form a top outside edge 210. The fold lines 140*a,b,c,d* joining the middle portions 110*a,b,c,d* to the lower portions 112*a,b,c,d* can form a bottom outside edge 220. The side strip 128 can be affixed to the first subpanel 102*a* by staples, hot melt glue, or other adhesives known in the art, or with no adhesive at all.

Figure 3:
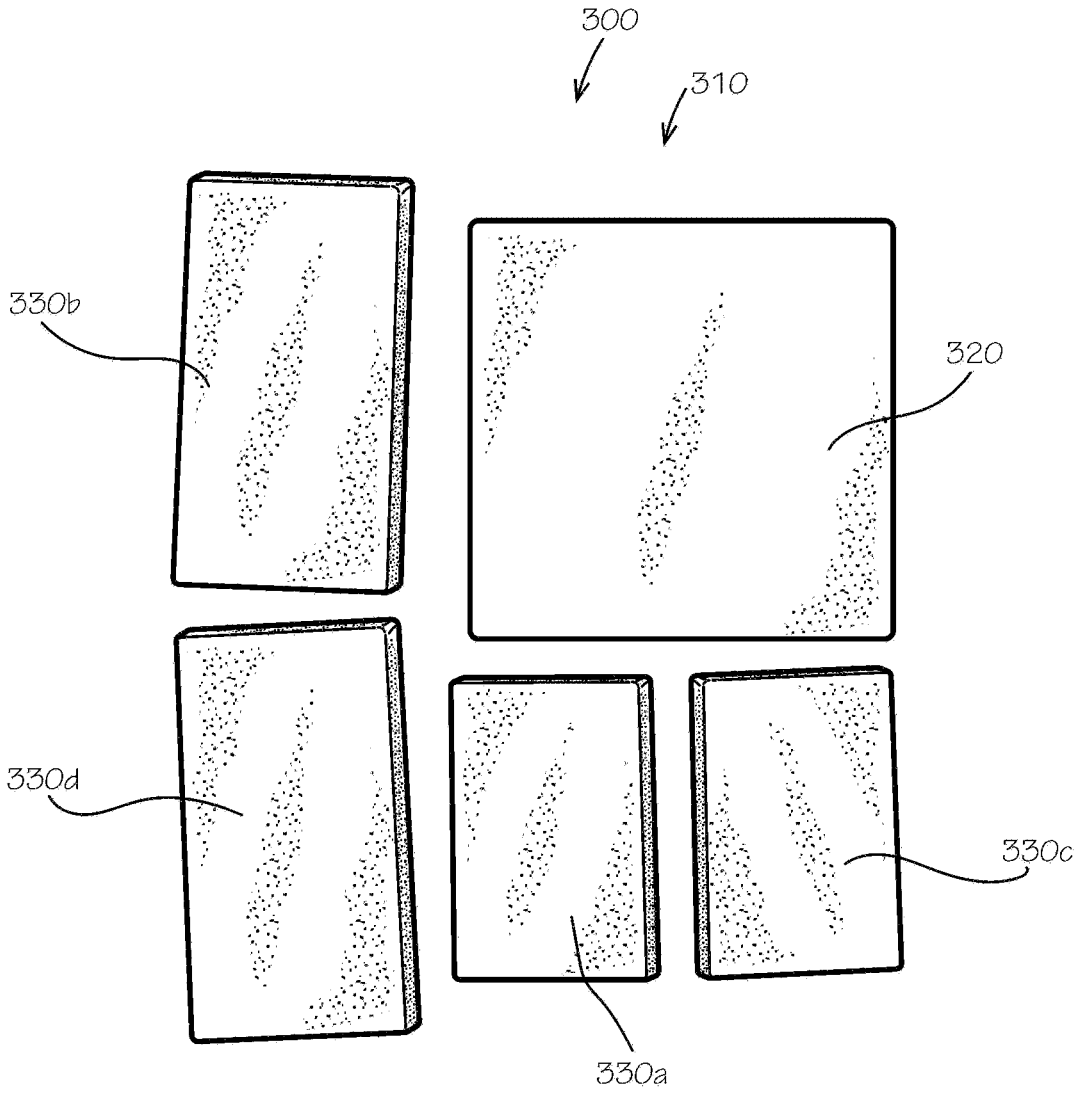
FIG. 3 shows a side view of insulator pads configured to be placed between an interior piece of the insulated box and the exterior piece, according to another aspect of the present disclosure.

FIG. 3 shows an exemplary aspect of an insulator 300 that can be used in the insulated box 2400. The insulator 300 can form a loose fill (not shown) or another configuration known in the art. In the current aspect, the insulator 300 can comprise insulator pads 310. The insulator pads 310 can comprise a variety of materials known in the art, such as polystyrene and/or cellulose. The insulator pads 310 can comprise a bottom insulator 320 and side insulators 330*a,b,c,d*. The side insulators 330*a,b,c,d* can comprise a first, second, third, and fourth side insulator 330*a,b,c,d*, respectively. The first and third side insulators 330*a,c* can be shorter than the second and fourth side insulators 330*b,d*. The side insulators can also comprise a single insulator pad (not shown) extending circumferentially around an interior piece 500.

The insulator pads 310 can comprise paper or other paper fiber materials; however, in other aspects, the insulation batts can comprise cotton, foam, rubber, plastics, fiberglass, mineral wool, or any other flexible insulation material. In the present application, the insulation batts can be repulpable. In the present aspect, the insulated box 2400 can be 100% recyclable. In the present aspect, the insulated box 2400 can be single-stream recyclable wherein all materials comprised by the insulated box 2400 can be recycled by a single processing train without requiring separation of any materials or components of the insulated box 2400. In the present aspect, the insulated box 2400 can be compostable. In the present aspect, the insulated box 2400 can be repulpable. In the present aspect, the insulated box 2400 and the insulator pads 310 can be repulpable in accordance with the requirements of the Aug. 16, 2013, revision of the "Voluntary Standard For Repulping and Recycling Corrugated Fiberboard Treated to Improve Its Performance in the Presence of Water and Water Vapor" provided by the Fibre Box Association of Elk Grove Village, Ill. which is hereby incorporated in its entirety. In the present aspect, the insulated box 2400 and the insulator pads 310 can be recyclable in accordance with the requirements of the Aug. 16, 2013, revision of the "Voluntary Standard For Repulping and Recycling Corrugated Fiberboard Treated to Improve Its Performance in the Presence of Water and Water Vapor" provided by the Fibre Box Association of Elk Grove Village, Ill.

Recyclable and repulpable insulation materials are further described in U.S. patent application Ser. No. 15/677,738, filed Aug. 15, 2017, U.S. Provisional Patent Application No. 62/375,555, filed Aug. 16, 2016, U.S. Provisional Patent Application No. 62/419,894, filed Nov. 9, 2016, and U.S. Provisional Patent Application No. 62/437,365, filed Dec. 21, 2016, which are each incorporated by reference in their entirety herein.

Figure 4:
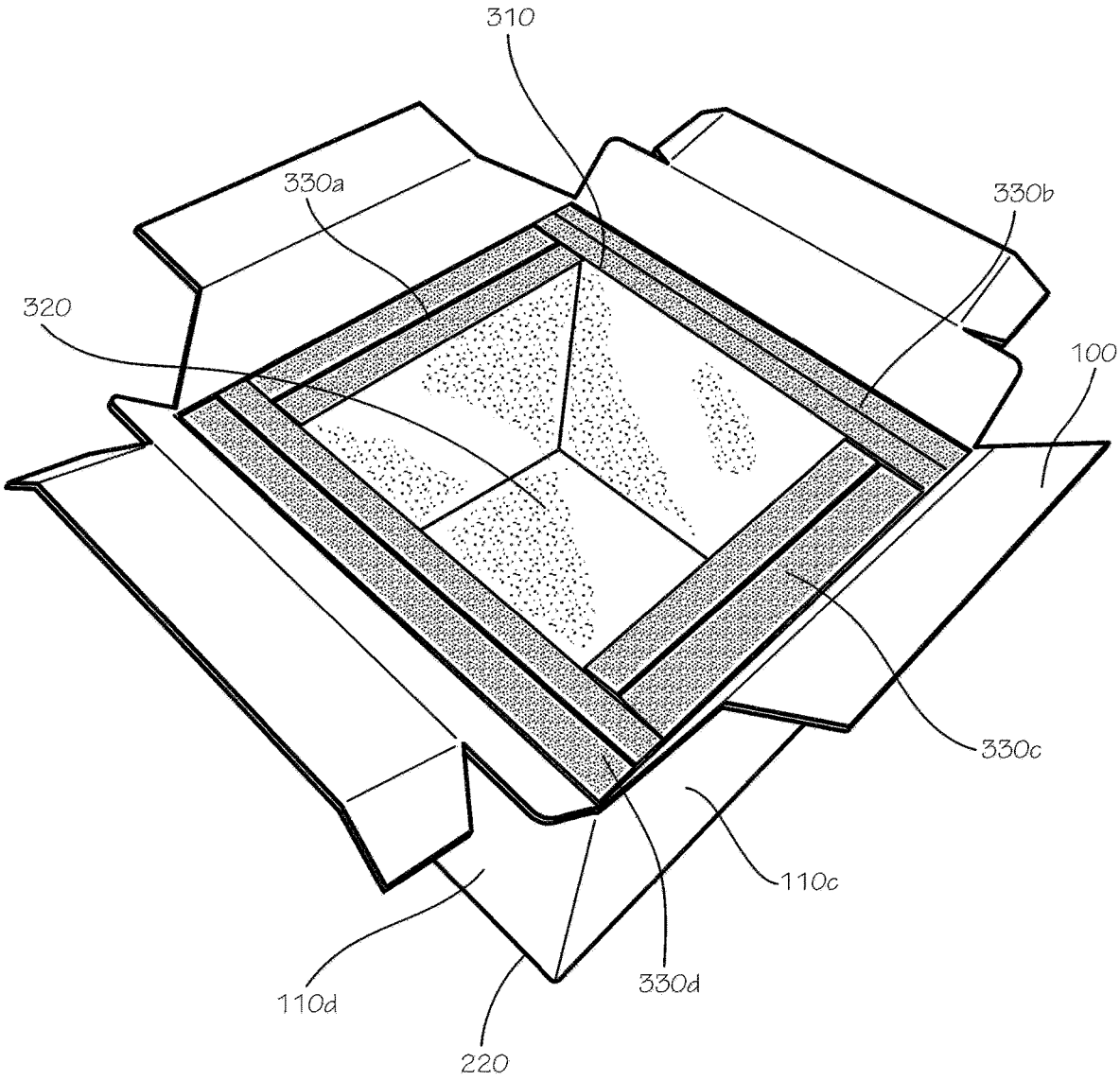
FIG. 4 is a perspective view of the insulator pads placed inside the exterior piece.

FIG. 4 is a perspective view of the partially assembled insulated box 2400. The insulator pads 310 are placed inside the assembled exterior piece 100. The bottom insulator 320 can cover, or proximately face, the lower portions 112*a,b,c,d* (not shown) of the exterior piece 100. The bottom insulator 320 can fully extend to the bottom outside edge 220. The side insulators 330*a,b,c,d* can alternate shorter and longer. For example, in the current aspect, the first side insulator 330*a* can be configured to proximately face the first middle portion 110*a* (not shown). Likewise, the second, third, and fourth side insulators 330*bc,d*, respectively, can be configured to face the corresponding numbered middle portions 110*b,c,d*.

Figure 5:
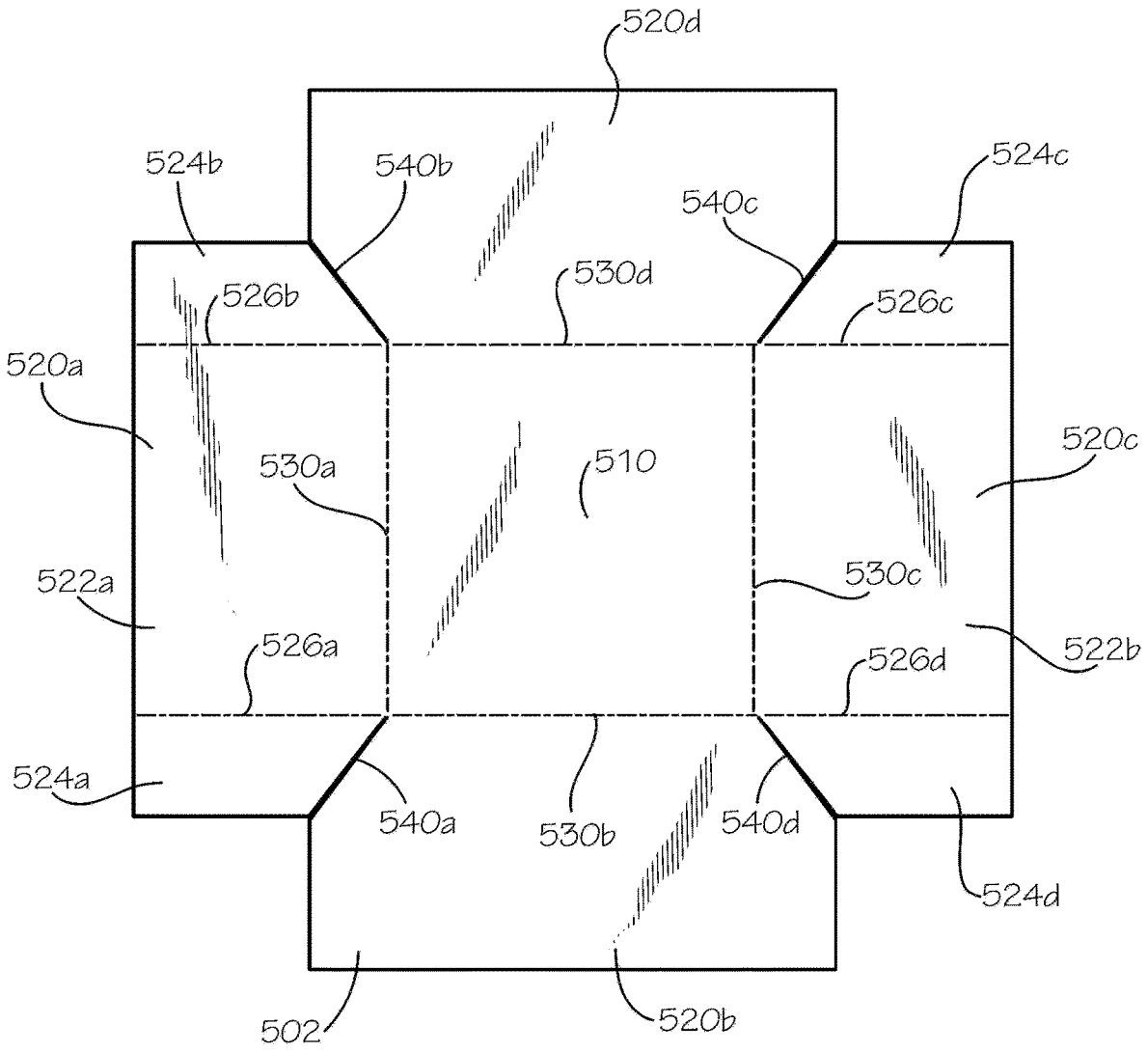
FIG. 5 shows a blank configured to be assembled into the interior piece of the insulated box.

FIG. 5 shows the interior piece 500 of the insulated box 2400 in an unassembled configuration. The interior piece 500 can comprise a bottom panel 510, side panels 520*a,b,c,d*, and fold lines 530*a,b,c,d* joining the bottom panel 510 to the side panels 520*a,b,c,d*. An interior surface 502 faces out of the page in FIG. 5. Alternating side panels—for example, a first and a third side panel 520*a,c*—can comprise a middle tab 522*a,b* and a side tab 524*a,b,c,d*. The middle tabs 522*a,b* can be joined to the side tabs 524*a,b,c,d* by fold lines 526*a,b,c,d*. A second and a fourth side panel 520*b,d* can lack fold lines. The interior piece 500 can be formed from a single flat piece with side panel cuts 540*a,b,c,d* separating the side panels 520*a,b,c,d* from each other. Thus, a blank of the interior piece 500 can be configured such that each side panel 520*a,b,c,d* is not connected to any other side panel 520*a,b,c,d*, except only indirectly through the bottom panel 510. The side panel cuts 540*a,b,c,d* can form angles with the fold lines 526*a,b,c,d*, the angles being approximately 45 degrees.

Figure 6:
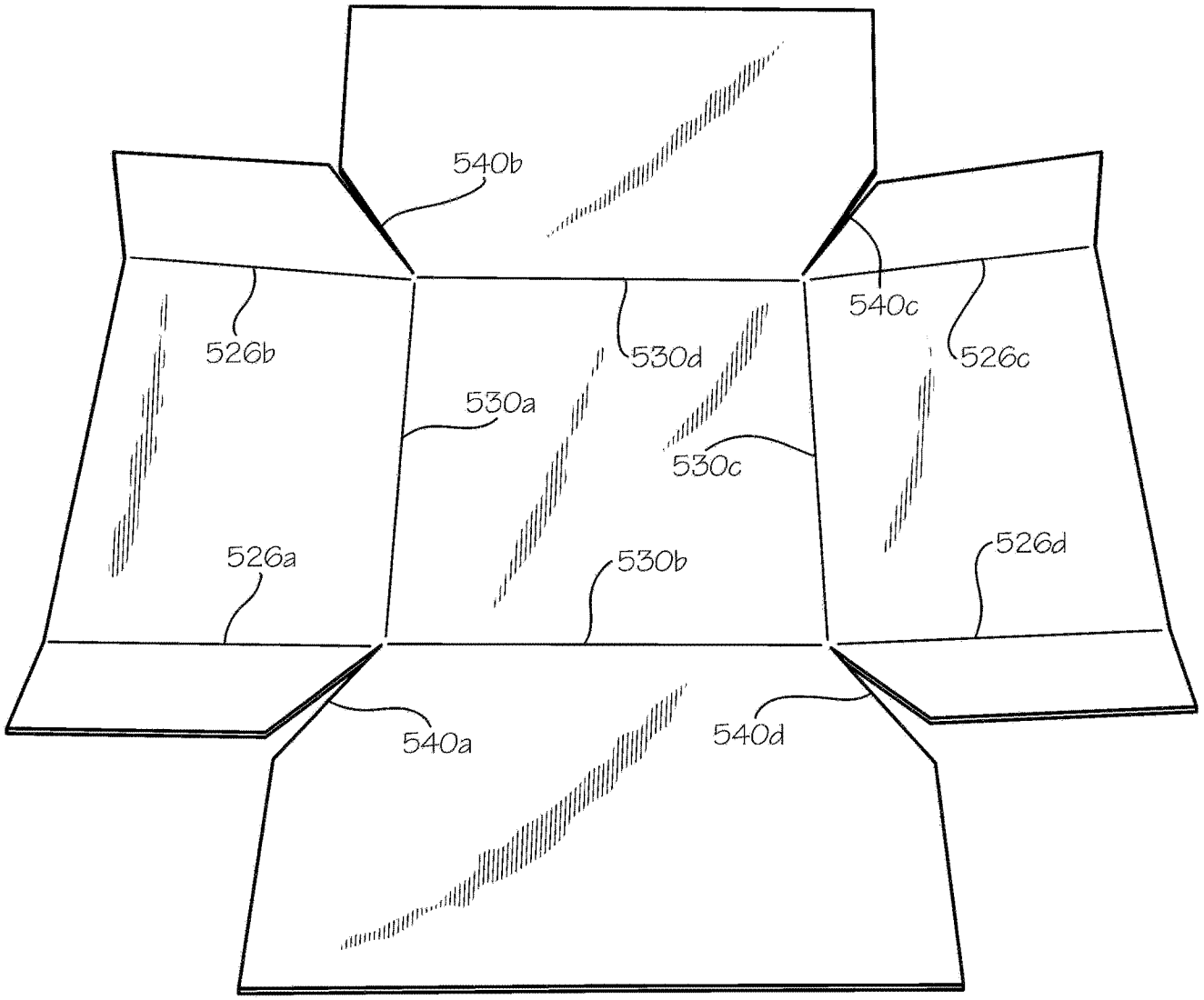
FIG. 6 is a perspective view of the blank of FIG. 5 with flaps of the blank slightly folded up.

FIG. 6 is a perspective view of the interior piece 500 with the fold lines 530*a,b,c,d;* 526*a,b,c,d* in a slightly bent configuration.

Figure 7:
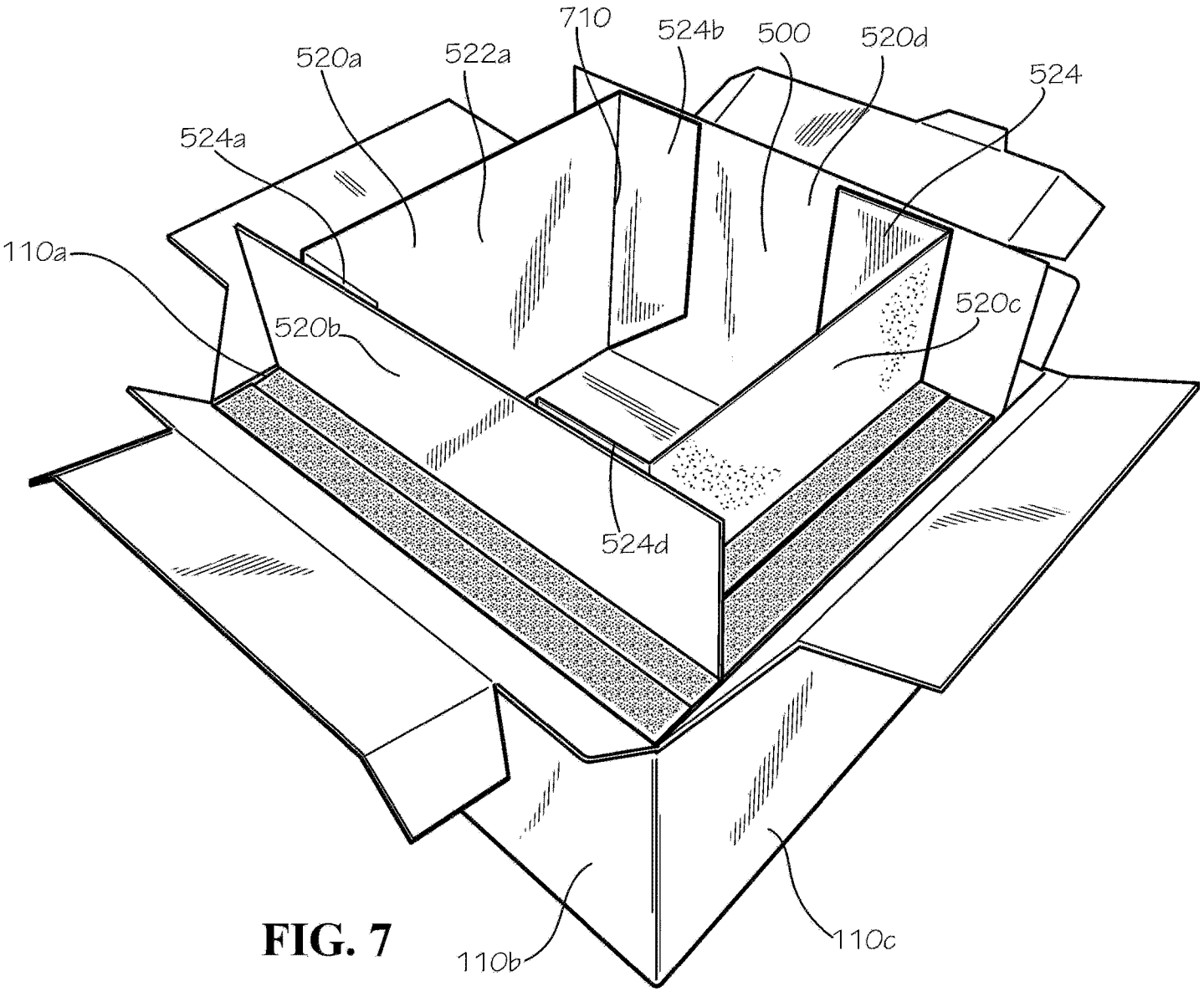
FIG. 7 is a perspective view of the interior piece positioned into the exterior piece with the insulator pads of FIG. 4 positioned therebetween.

FIG. 7 is a perspective view of the interior piece 500 partially inside the partially assembled box of FIG. 4. The middle tab 522*a* of the first side panel 520*a* of the interior piece 500 can be configured to proximately face the first middle portion 110*a* of the exterior piece 100. Likewise, the second, third, and fourth side panels 520*b,c,d* of the interior piece 500 can face the corresponding middle portions 110*b,c,d* of the exterior piece 100. Alternating side panels—for example, the second and fourth side panels 520*b,d*—can be configured to extend completely between the second and fourth middle portions 110*b,d* of the exterior piece 100. The side tabs 524*a,b,c,d* of the side panels 520*a,c* can be configured to fold inwards toward a cavity 710 in the insulated box 2400.

Figure 8:
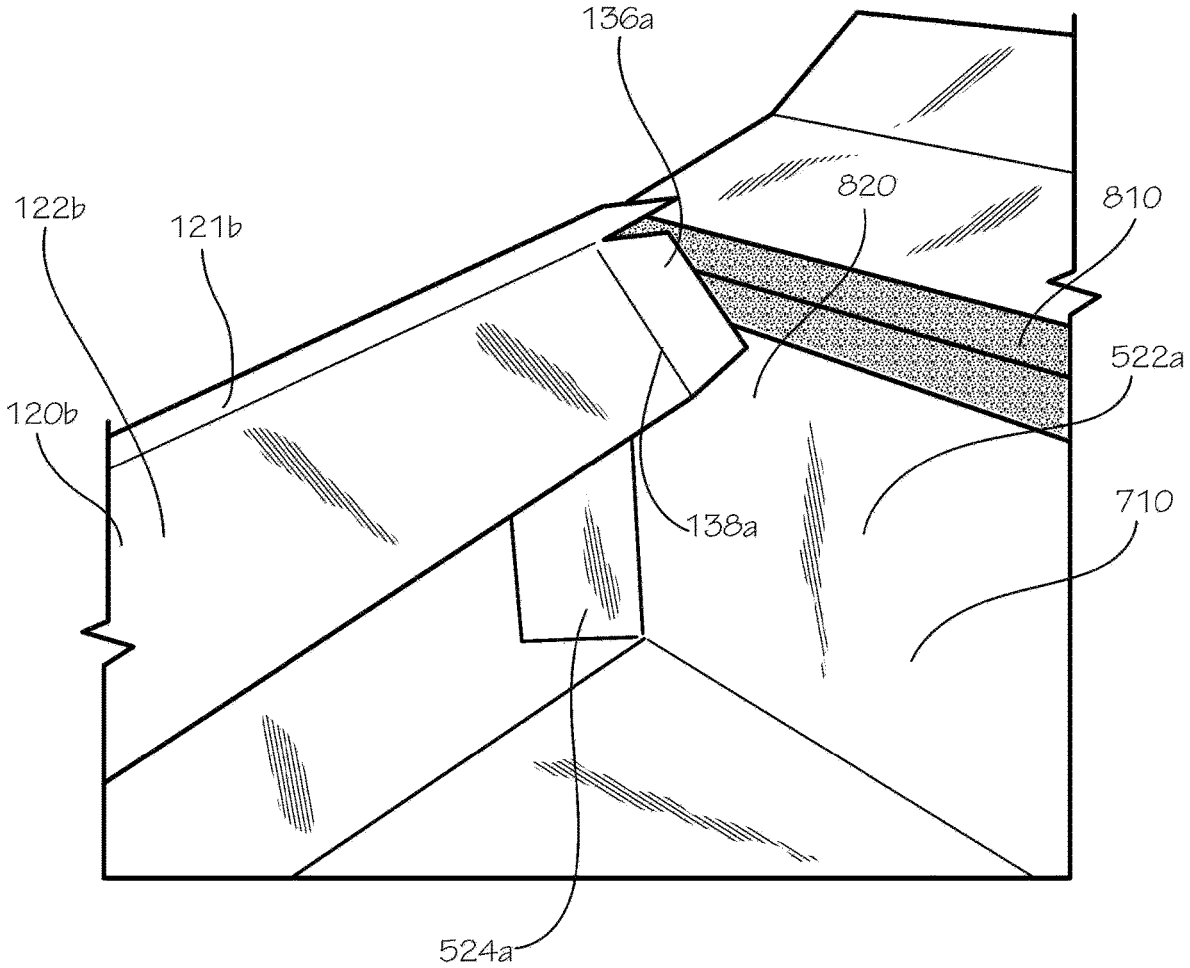
FIG. 8 is a perspective view of a top interior corner of the interior piece, with an upper portion of the exterior piece folded over to overlap a top edge of the interior piece.

FIG. 8 is a perspective view of the partially assembled insulated box 2400, showing a close-up of one of the exterior piece's 100 upper portions 120*b* (of the exterior piece 100) comprising an end segment 122*b* comprising a side tab 136*a*. The connecting segment can be configured to fold down toward the cavity 710 and cover a top edge 810 of the insulating pads 310. In other aspects (not shown) in accordance with the present disclosure, the insulator pads can be omitted, in which case the insulating properties of air left behind in a space or gap left between the interior piece 500 and the exterior piece 100 can insulate the insulated box 2400. In yet other aspects, at least a portion of the upper portion 120*a,b,c,d* of the exterior piece 100—not necessarily the connecting segment 121*a,c*—can cover at least some portion of the space. In other words, "covering" can comprise "partially covering."

The end segment 122*b* can be configured to overlap or cover a top interior portion 820 of the assembled interior piece 500. In some aspects, only a portion of the top interior portion 820 may be covered by a portion of the upper portion 120*a,b,c,d* of the exterior piece 100. The side tab 136*a* can overlap the side panel adjoining the side panel overlapped by the end segment 122*b*, which in this aspect can be side panel 520*a*.

Figure 9:
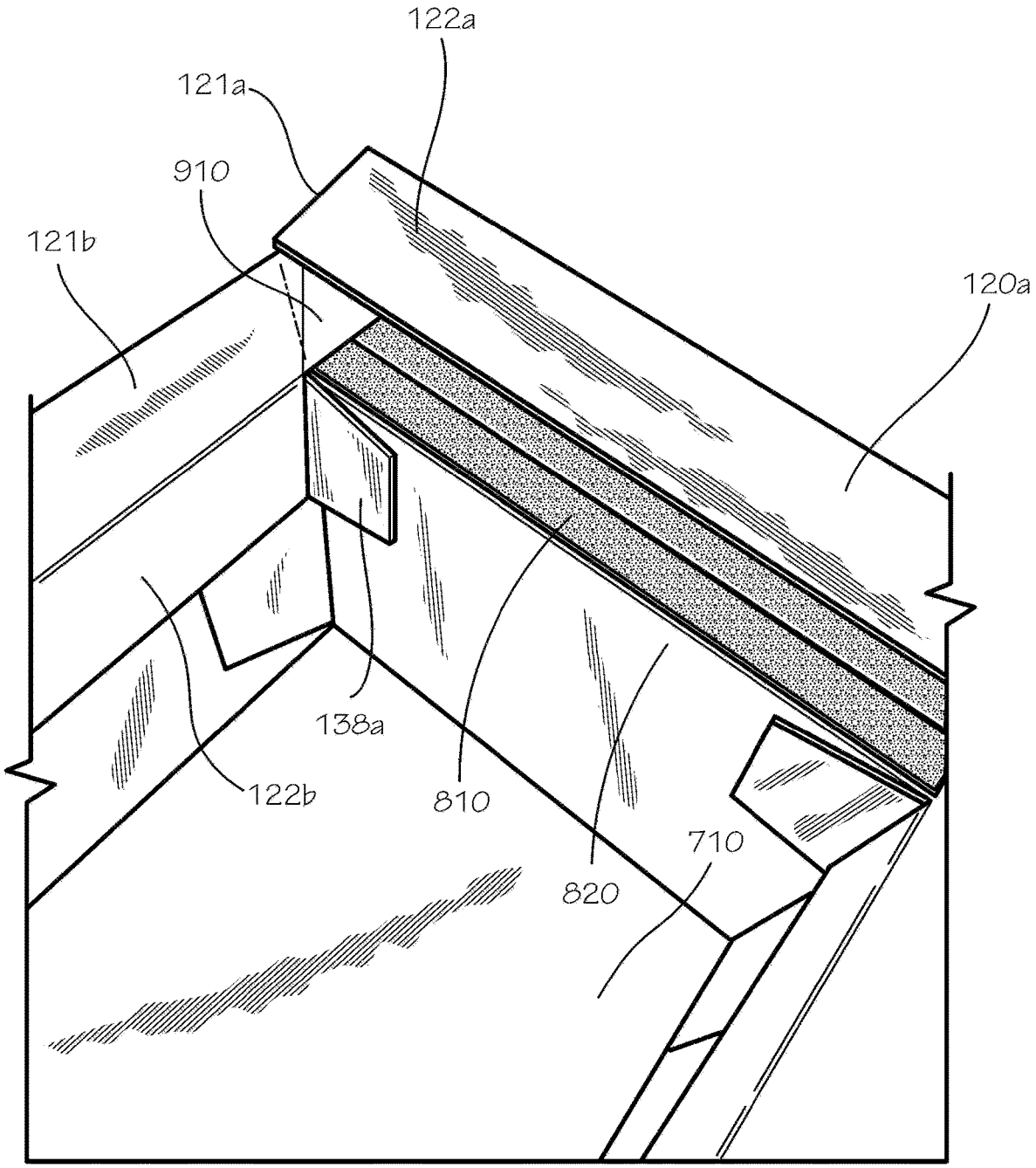
FIG. 9 is a perspective view of the partially assembled insulated box, with another upper portion of the exterior piece in the process of being folded over to overlap the top edge of the interior piece.

FIG. 9 is a perspective view of the partially assembled insulated box 2400, showing the next step in assembly after FIG. 8. The upper portion 120*a* can be configured to fold down toward the cavity 710. The connecting segment 121*a* can overlap a corner 910 of the adjoining connecting segment. The end segment 122*a* can overlap the top interior portion 820 of the interior piece 500 and further overlap the side tab 136*a* of the exterior piece 100. The end segments 122*a* can be affixed in place by adhesives known in the art or by friction without adhesive.

Figure 10:
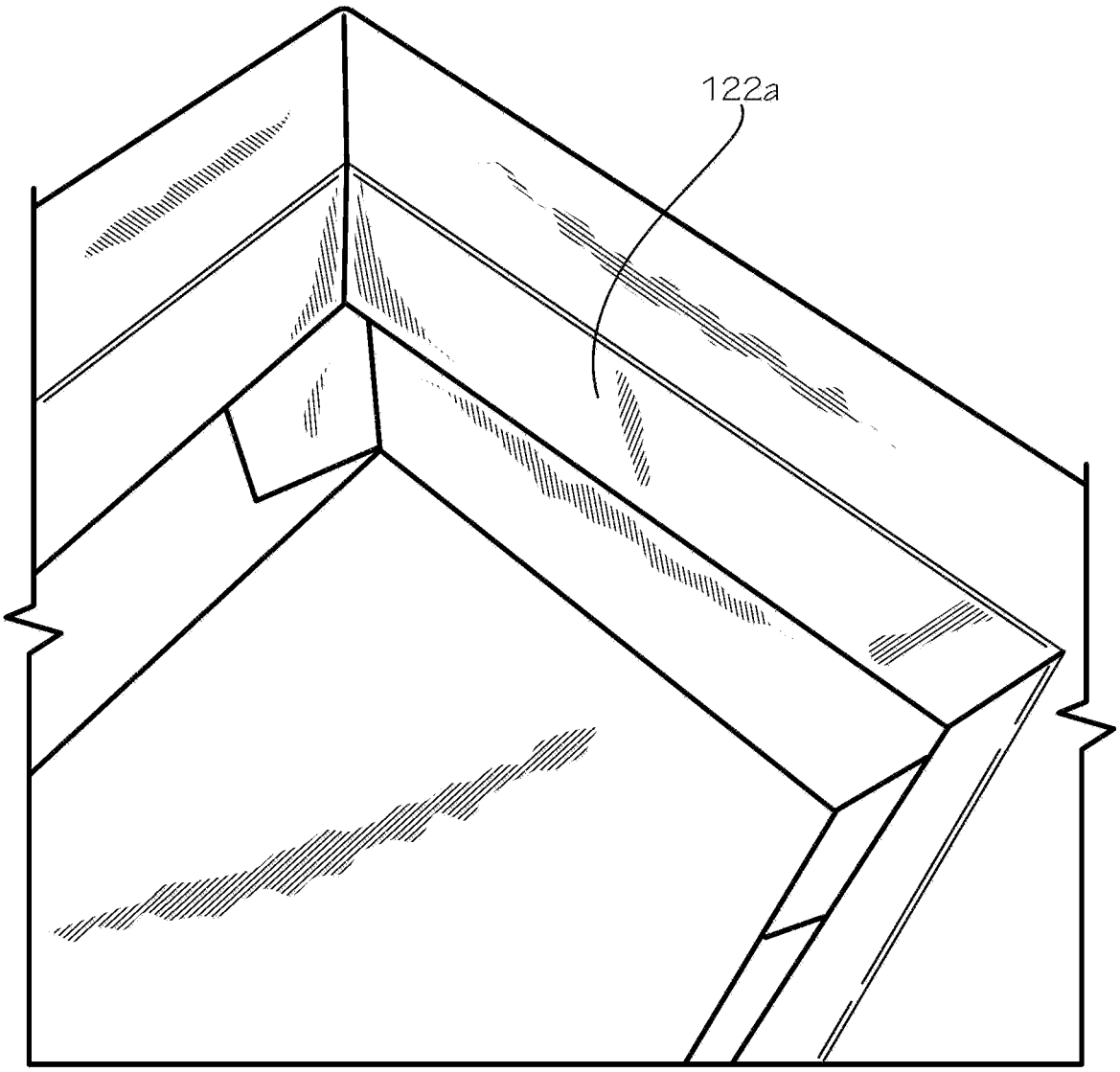
FIG. 10 is a perspective view of the insulated box after another upper portion of the exterior piece has been folded over to overlap the top edge of the interior piece.

FIG. 10 shows the insulated box 2400 after the step shown in FIG. 9 has been completed. The end segment 122*a* overlaps side panel 520*a* and side tab 136*a* of the exterior piece 100.

Figure 11:
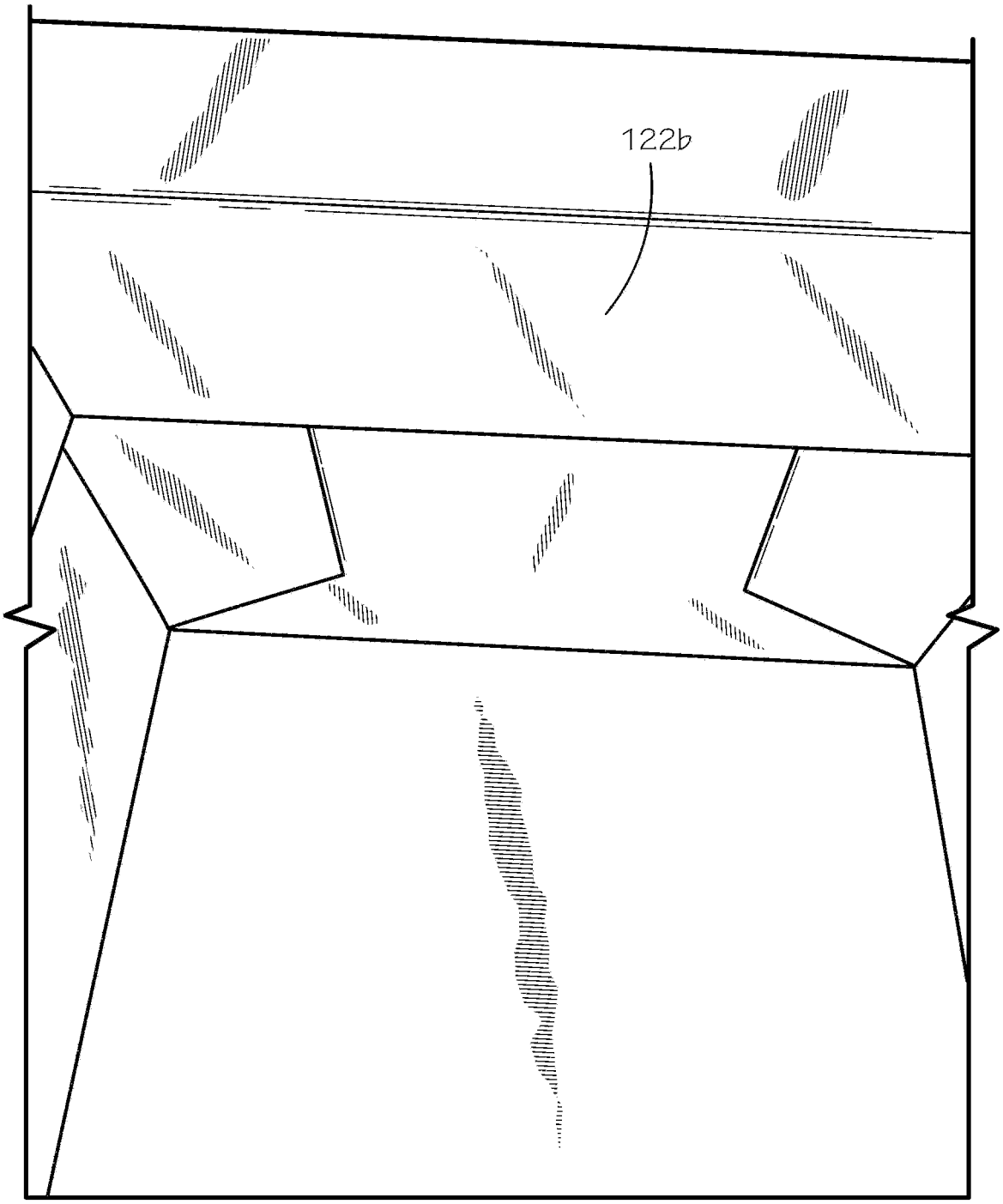
FIG. 11 is a perspective view of an interior of the insulated box with the upper portions of the exterior piece folded over and overlapping side panels of the interior piece.

FIG. 11 shows another view of the insulated box 2400, particularly a close-up of end segment 122*b*.

Figure 12:
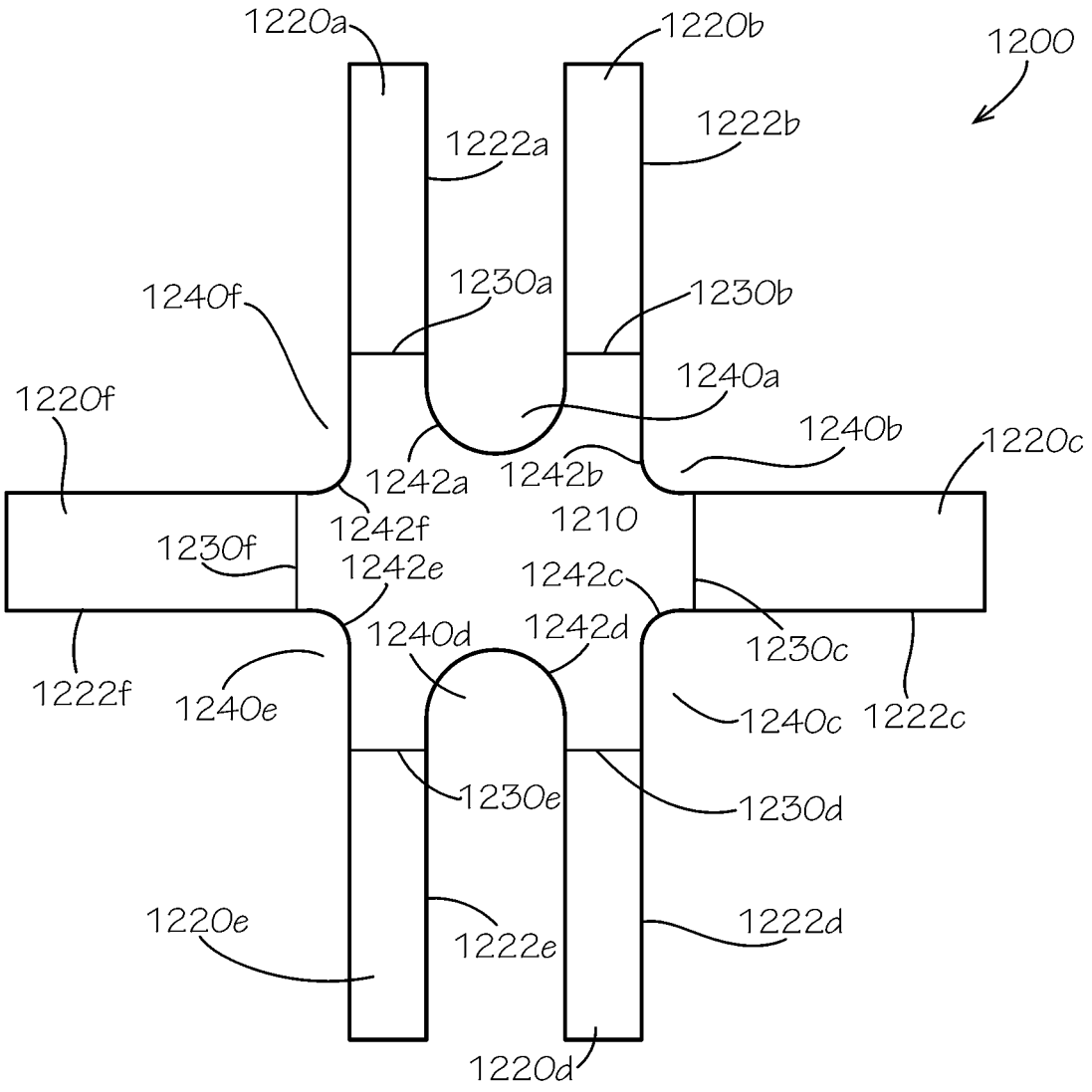
FIG. 12 shows a blank configured to be assembled into a box insert with vertical rails in accordance with another aspect of the present disclosure.

FIG. 12 is a top view of a box insert 1200 with vertical rails 1220 in a flat configuration. The box insert 1200 can comprise a center segment 1210 and vertical rails 1220*a,b,c,d,e,f* joined thereto by fold lines 1230*a,b,c,d,e,f*. The center segment 1210 can comprise cutouts 1240*a,b,c,d,e,f*. An edge 1242*a,b,c,d,e,f* of each cutout 1240*a,b,c,d,e,f* can be contiguous with an edge 1222*a,b,c,d,e,f* of each vertical rail 1220*a,b,c,d,e,f*, respectively. The edges 1242*a,b,c,d,e,f* of the cutouts 1240*a,b,c,d,e,f* can be curvilinear, rectilinear, or some other shape. The edges 1222*a,b,c,d,e,f* of the vertical rails 1220*a,b,c,d,e,f* can be curvilinear or rectilinear or some other shape.

Figure 13:
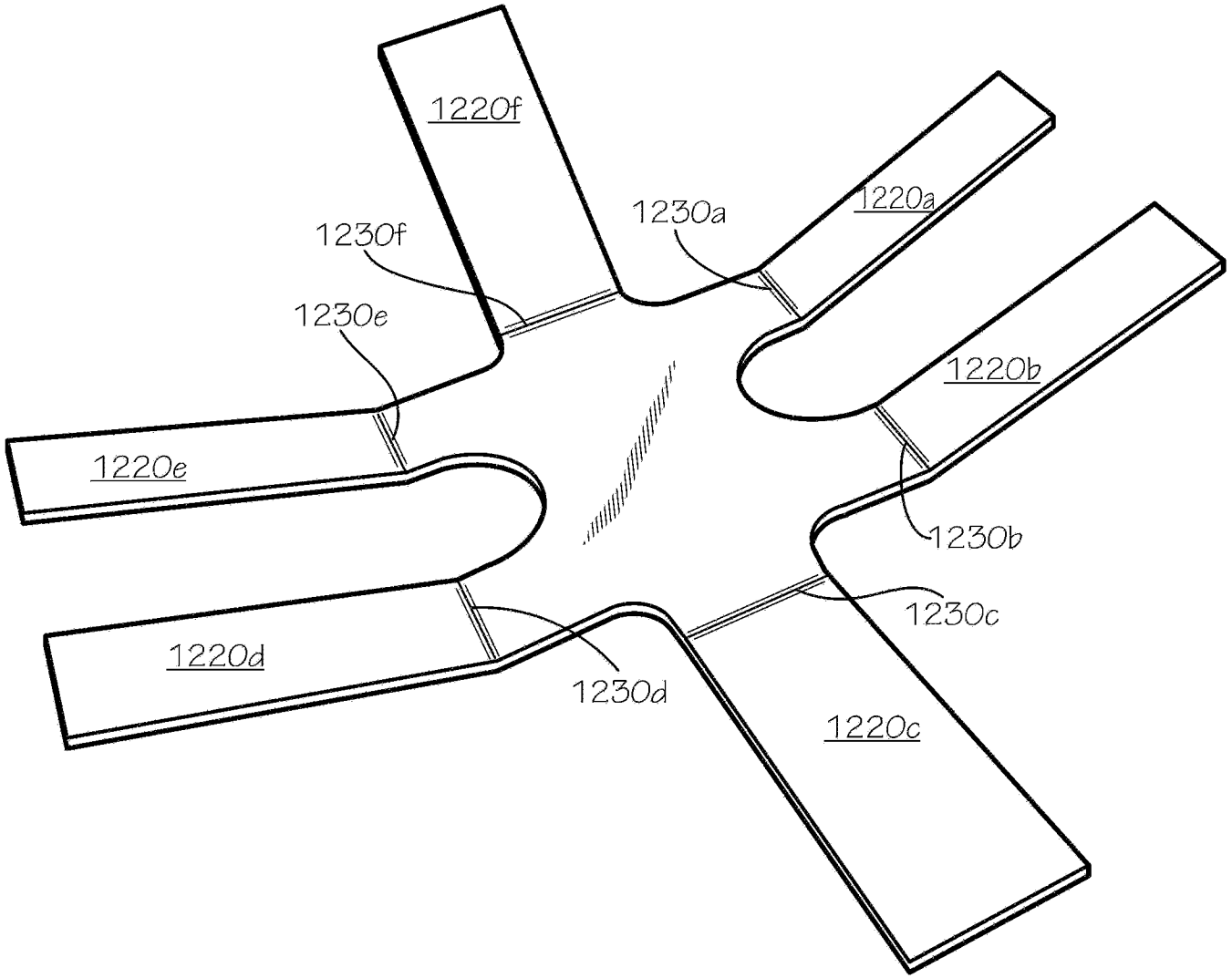
FIG. 13 is a perspective view of the blank of FIG. 12 with rails folded slightly upwards.

FIG. 13 is a perspective view of the box insert 1200. The vertical rails 1220*a,b,c,d,e,f* of the box insert 1200 can be configured to bend upward along the fold lines 1230*a,b,c,d,e,f*. As shown in the current aspect, the fold lines 1230*a,b,c,d,e,f* between the vertical rails 1220*a,b,c,d,e,f* and the center segment 1210 can coincide with the fold lines 530*a,b,c,d* between the bottom panel 510 and the side panels 520*a,b,c,d* of the interior piece 500.

Figure 14:
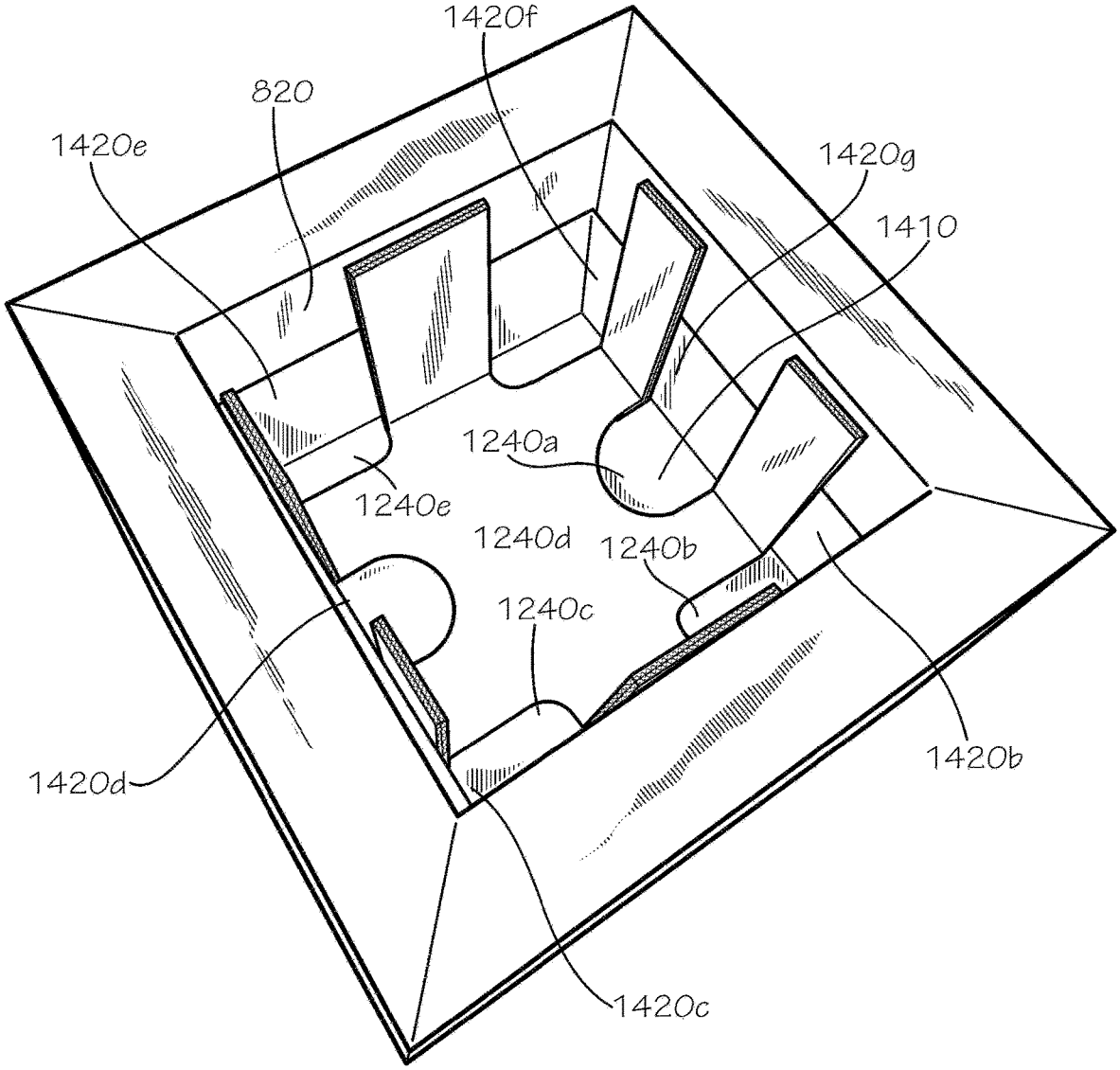
FIG. 14 is a perspective view of the insert with vertical rails inside the insulated box.

FIG. 14 is a perspective view of the box insert 1200 inside the insulated box 2400. The cutouts 1240*a,b,c,d,e,f* can be configured to expose regions of a bottom 1410 of the cavity 710. The box insert 1200 can be configured to allow air to flow to and from the cutouts 1240*a,b,c,d,e,f* and spaces 1420*a,b,c,d,e,f* between the vertical rails. The vertical rails 1220*a,b,c,d,e,f* can be configured to extend to the top interior portion 820.

Figure 15:
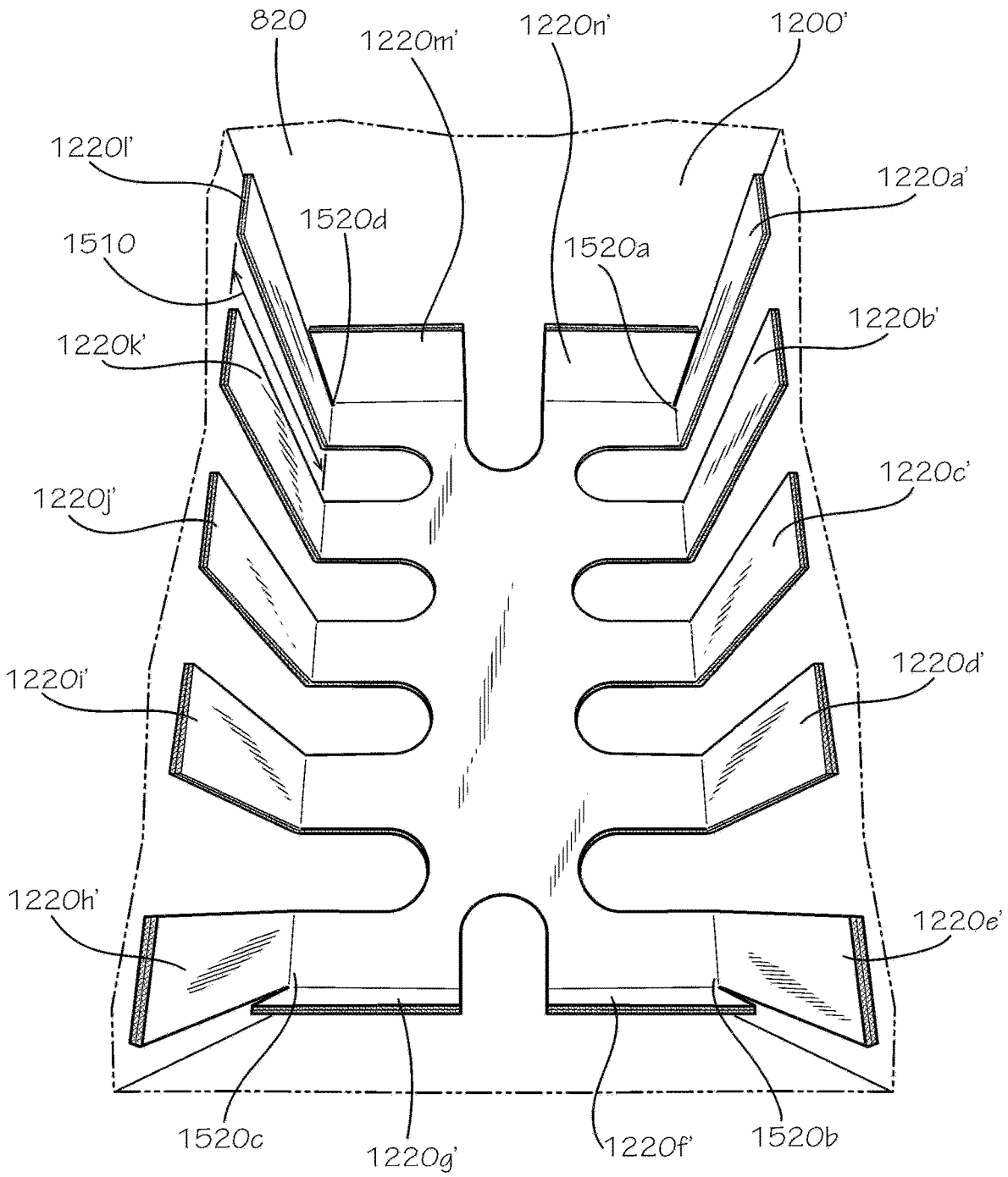
FIG. 15 is a perspective view of the insert with vertical rails in accordance with another aspect of the present disclosure.

FIG. 15 is a perspective view of the box insert 1200' in another exemplary aspect. In the current aspect, the vertical rails 1220*a',b',c',d',e',f',g',h',i',j',k',l',m',n'* can be configured to rise to a height 1510 below the top interior portion 820. The vertical rails 1220*a',e',f',g',h',l',m',n'* can also be configured to adjoin each other at bottom corners 1520*a,b,c,d*—without a space 1420 between them.

Figure 16:
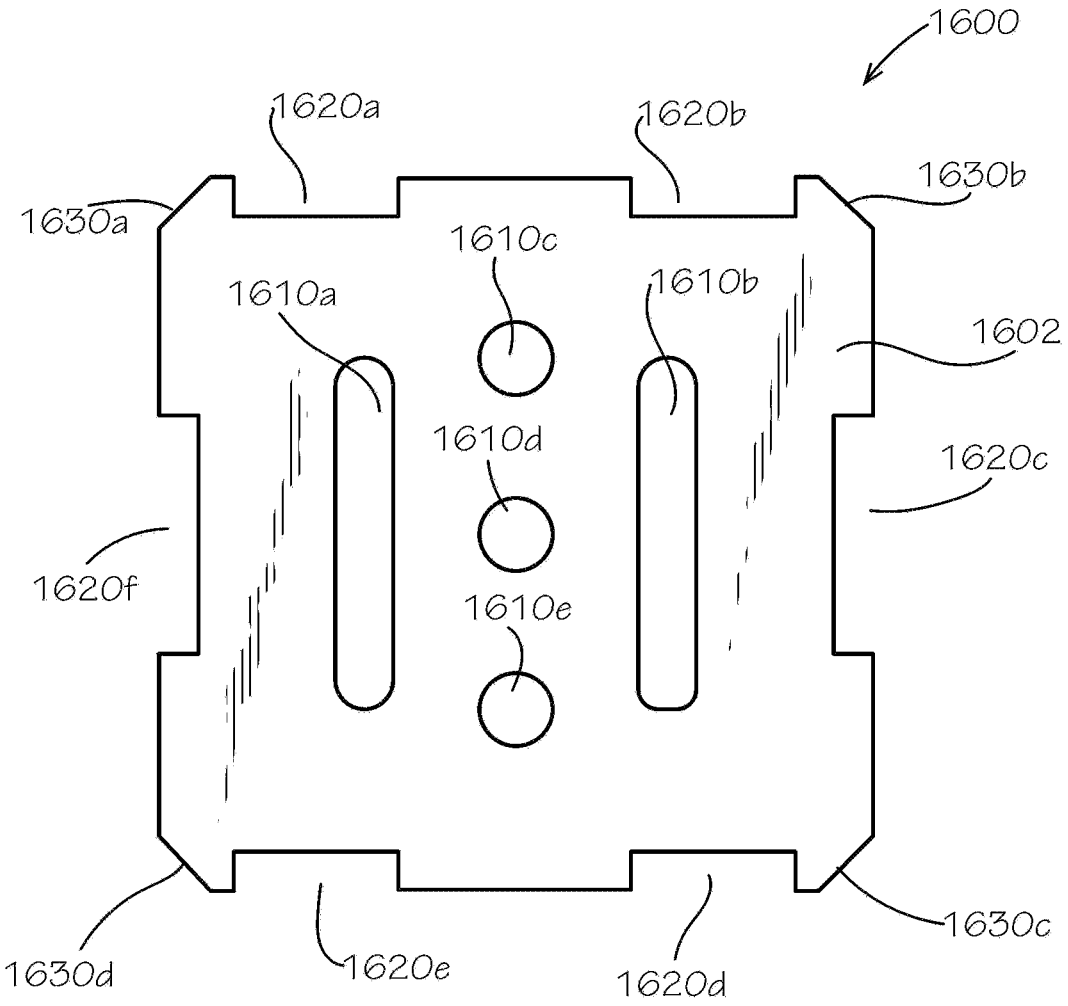
FIG. 16 is a top view of a register configured to slide up and down along the vertical rails of the insert of FIG. 12.

FIG. 16 is a top view of a register 1600. The register 1600 can comprise a face segment 1602. The face segment 1602 can comprise holes 1610*a,b,c,d*; side cutouts 1620*a,b,c,d,e,f*; and corner cutouts 1630*a,b,c,d*. The register can be cut from a single flat piece.

Figure 17:
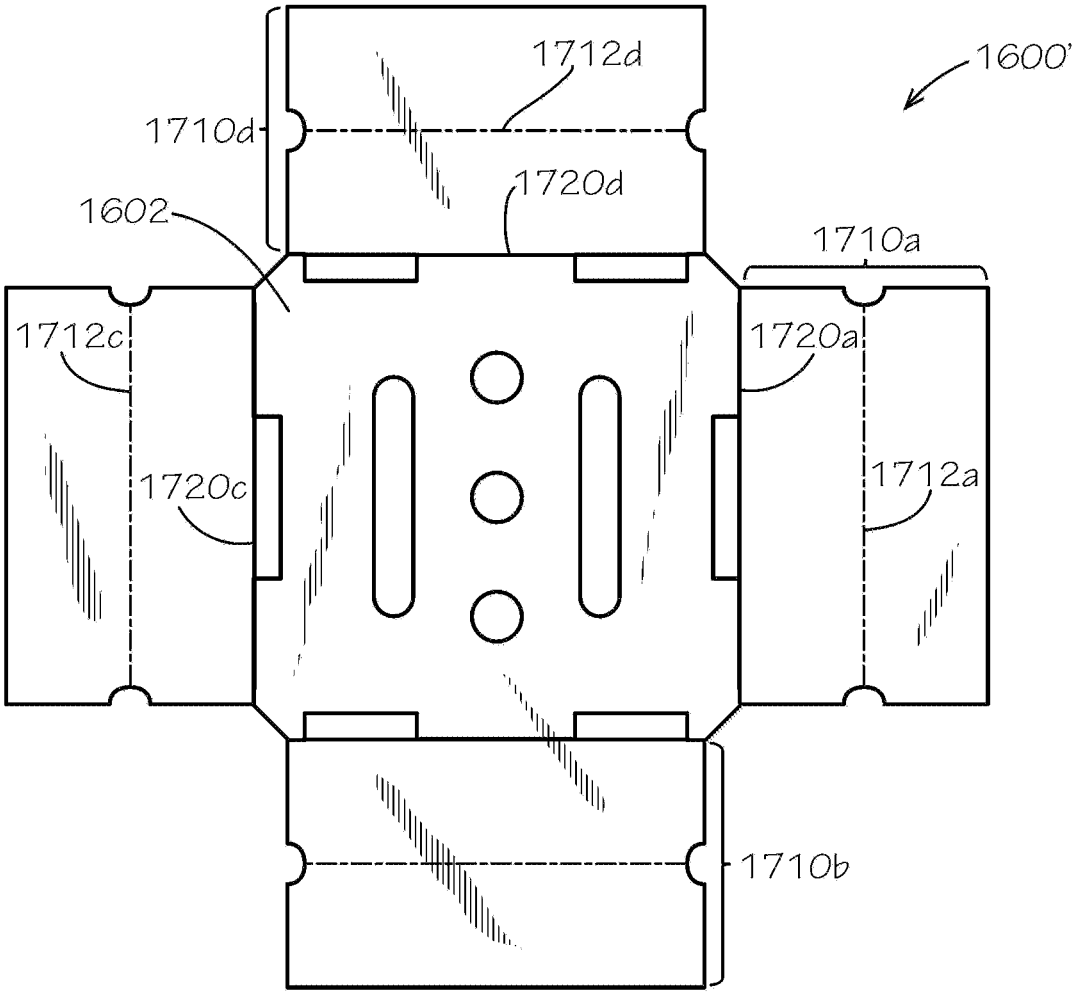
FIG. 17 is a top view of a register configured to slide up and down along the vertical rails of the insert of FIG. 12 in accordance with another aspect of the present disclosure.

FIG. 17 is a top view of a register 1700' in another exemplary aspect. The register 1600' can further comprise side segments 1700*a,b,c,d* joined to the face segment 1602 by fold lines 1720*a,b,c,d*. The side segments 1700*a,b,c,d* can comprise fold lines 1712*a,b,c,d* configured to be parallel to the corresponding fold lines 1720*a,b,c,d*.

Figure 18:
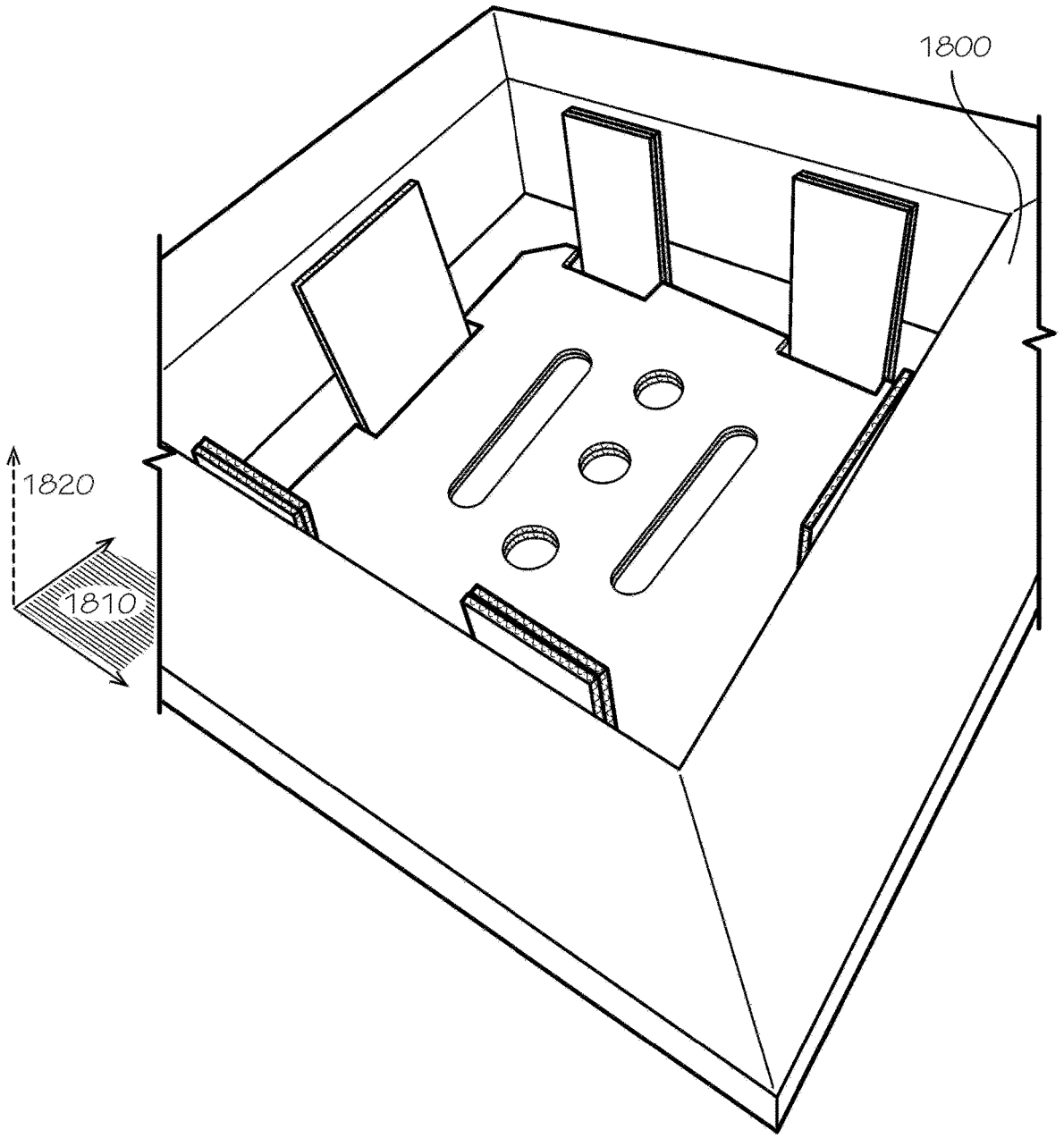
FIG. 18 is a perspective view of the register positioned in the insulated box as configured in FIG. 14.

FIG. 18 is a perspective view of the box insert 1200 receiving the register 1600. The register 1600 and the box insert 1200 can together form a registration system 1800. The registration system 1800 can be configured to allow the register 1600 to slide up and down the vertical rails 1220*a,b,c,d,e,f* along a vertical axis 1820 while the face segment 1602 is maintained in a horizontal plane 1810. The center segment 1210 can be configured to cover a bottom interior of the box 2400, and one or more of the vertical rails 1220*a,b,c,d,e,f* can be configured to cover a side interior of the box 2400. The register 1600 can be configured to slidably move along one or more of the vertical rails 1220*a,b,c,d,e,f* while maintaining a horizontal position, and the cutout 1620*a,b,c,d,e,f* of the register 1600 can be configured to surround one or more of the vertical rails 1220*a,b,c,d,e,f* of the box insert 1200.

Figure 19:
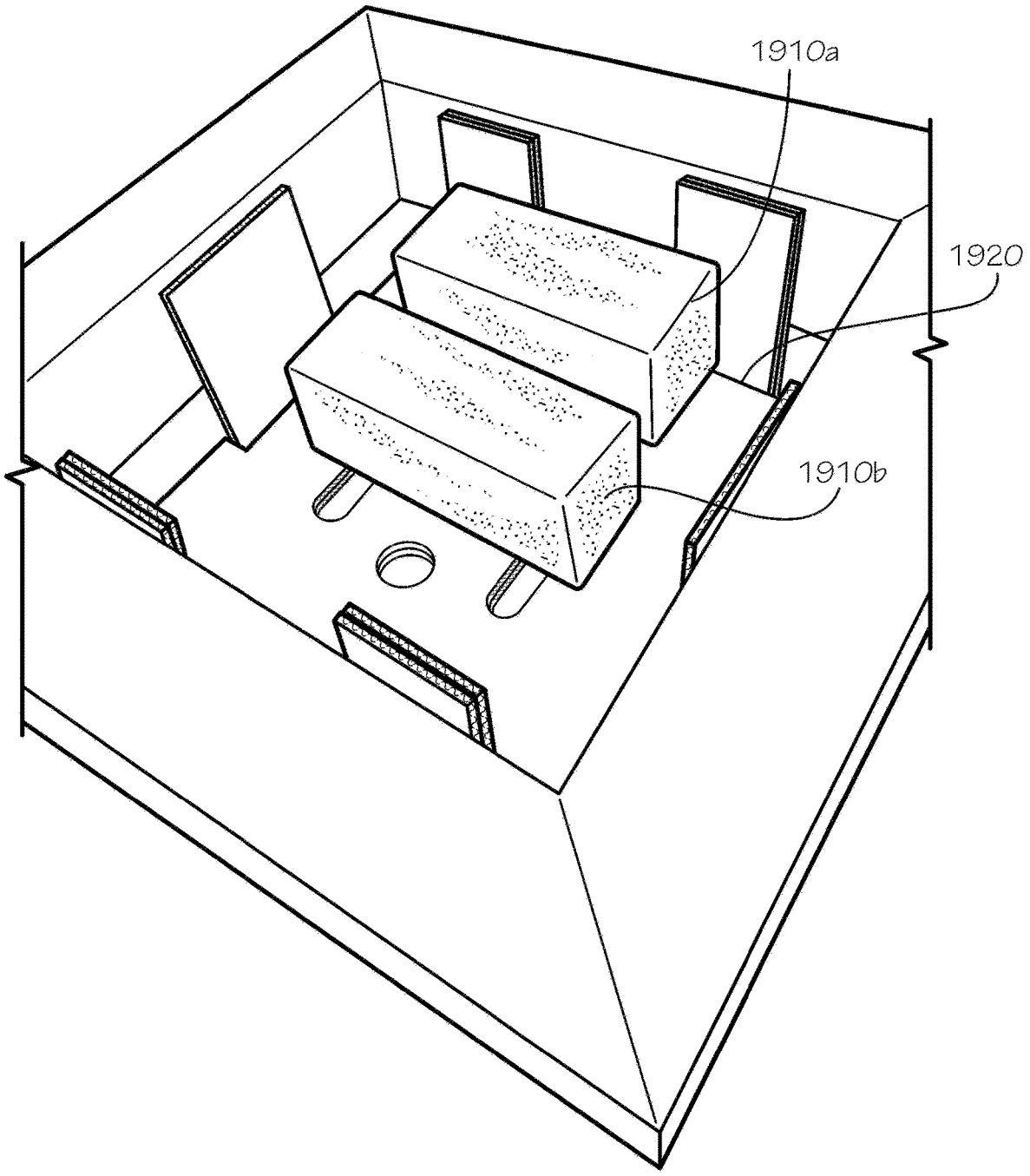
FIG. 19 is a perspective view of the insulated box of FIG. 18 comprising the register and with a representation of ice packs placed over the register.

FIG. 19 is a perspective view of the registration system 1800. The side cutouts 1620*a,b,c,d,e,f* can be configured to receive the vertical rails 1220*a,b,c,d,e,f* such that the register 1600 does not tip over when an overhead weight 1910*a,b* is placed near an edge 1920 of the face segment 1602 or when the register 1600 is not supported under a center of mass (not shown) of the register 1600 with the overhead weight 1910*a,b*.

Figure 20:
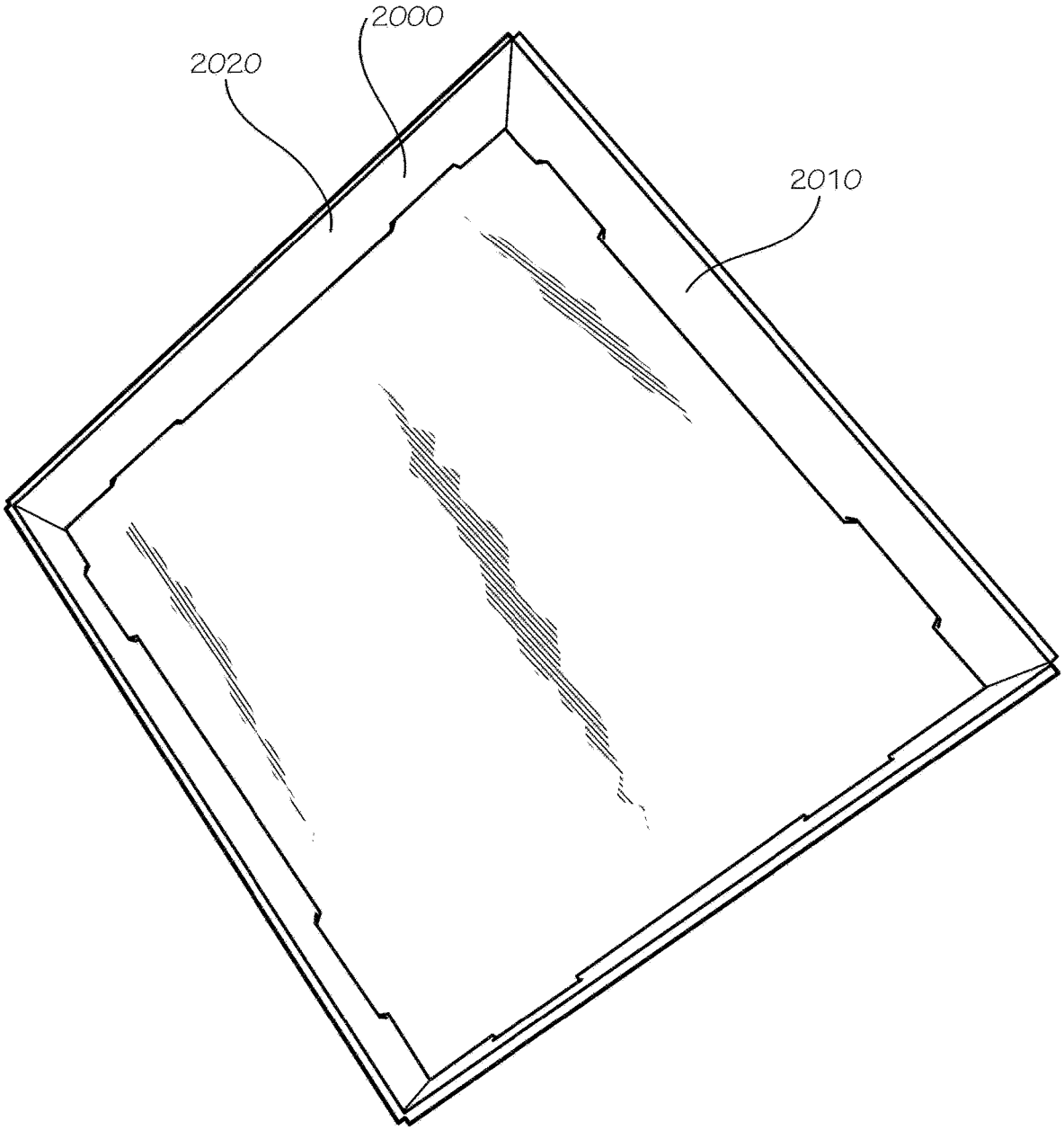
FIG. 20 is a perspective view of an assembled lid in accordance with another aspect of the present disclosure.

FIG. 20 is a perspective view of a lid 2000 for the insulated box 2400. The lid 2000 can comprise an inner piece 2010 and an outer piece 2020.

Figure 21:
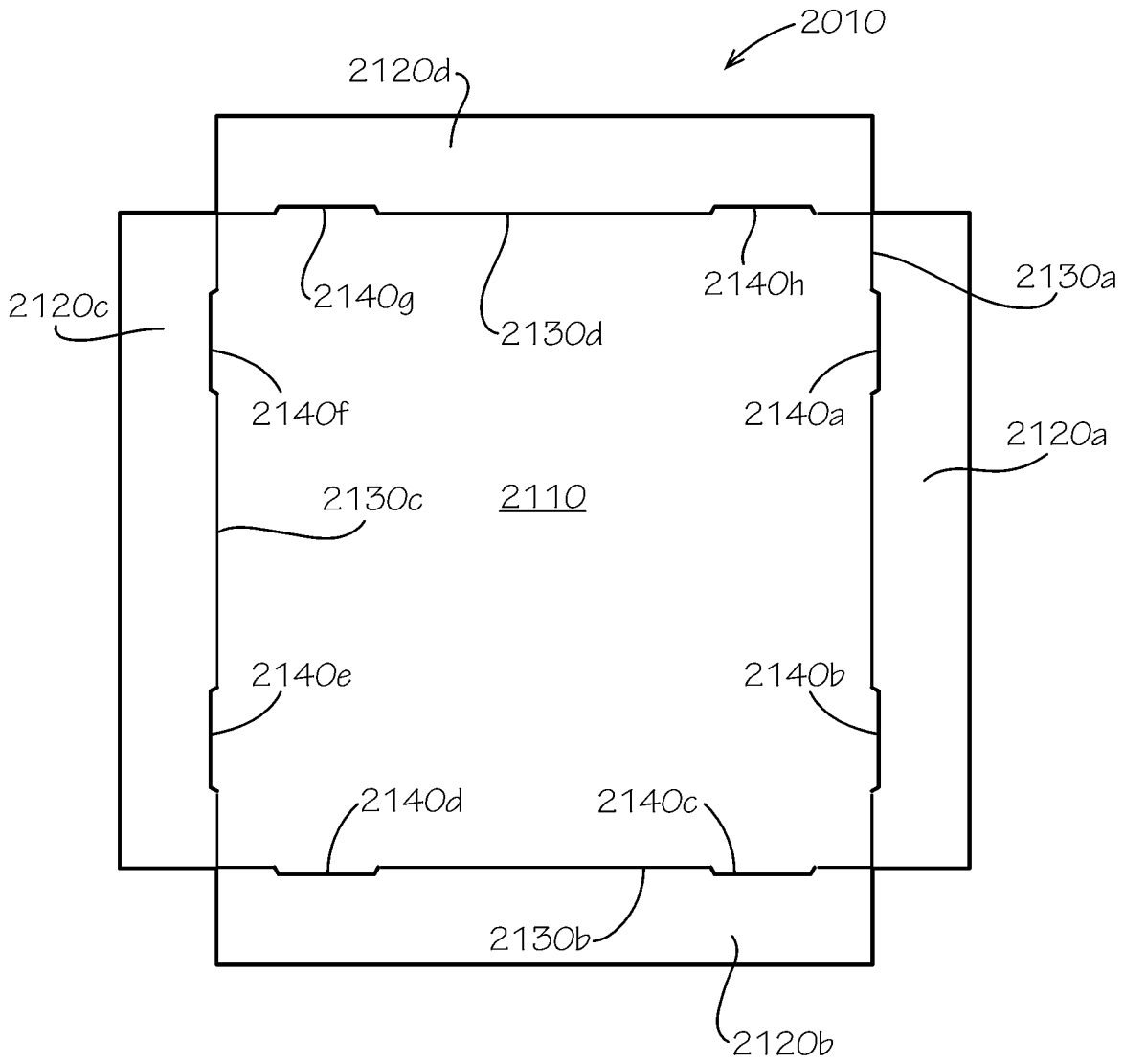
FIG. 21 shows a blank configured to be assembled into an inner piece of the lid of FIG. 19.

FIG. 21 is a top view of the inner piece 2010 of the lid 2000 in a flat, unassembled configuration. The inner piece 2010 can comprise a center segment 2110 and side segments 2120*a,b,c,d* joined to the center segment 2110 by fold lines 2130*a,b,c,d*. The fold lines 2130*a,b,c,d* can comprise tab cuts 2140*a,b,c,d,e,f,g,h*.

Figure 22:
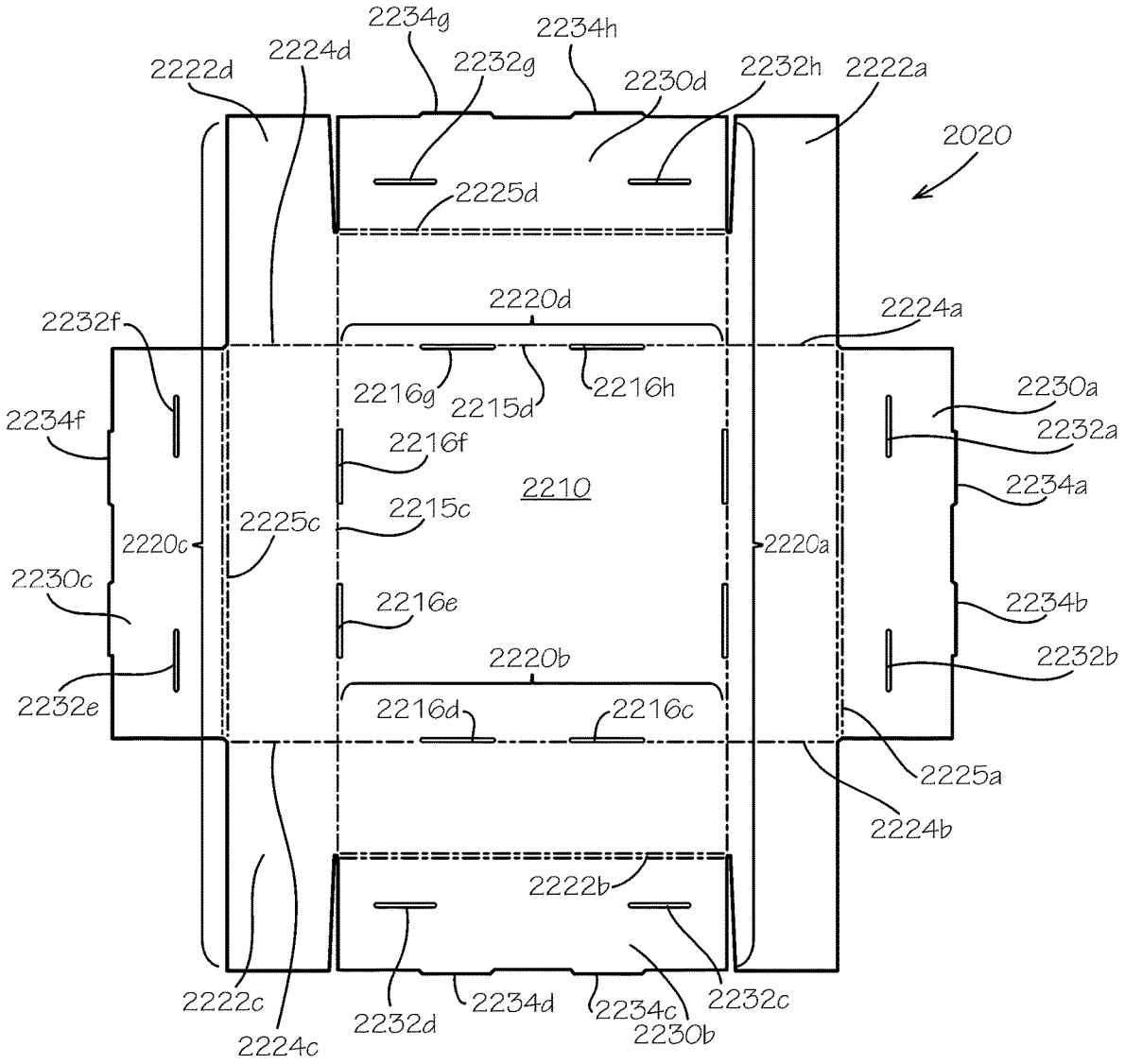
FIG. 22 shows a blank configured to be assembled into an outer piece of the lid of FIG. 19.

FIG. 22 is a top view of the outer piece 2020 of the lid 2000 in a flat, unassembled configuration. The outer piece 2020 can comprise a center segment 2210, connecting segments 2220*a,b,c,d* joined to the center segment 2210 by fold lines 2215*a,b,c,d*, and end segments 2230*a,b,c,d* joined to the connecting segments 2220*a,b,c,d* by fold lines 2225*a,b,c,d*. The fold lines 2225*a,b,c,d* can be double fold lines. Alternating segments, such as a first and a third connecting segment 2220*a,c*, can comprise side tabs 2222*a,b,c,d* joined to the connecting segments 2220*a,c* by fold lines 2224*a,b,c,d*. The fold lines 2215*a,b,c,d* joining the center segment 2210 to the connecting segments 2220*a,b,c,d* can comprise or define slots 2216*a,b,c,d,e,f,g,h*. The end segments 2230*a,b,c,d* can comprise tab slots 2232*a,b,c,d,e,f,g,h* and tabs 2234*a,b,c,d,e,f,g,h*. Any one or more of the fold lines disclosed herein can be defined by the parts joined by or at the corresponding fold line(s).

Figure 23:
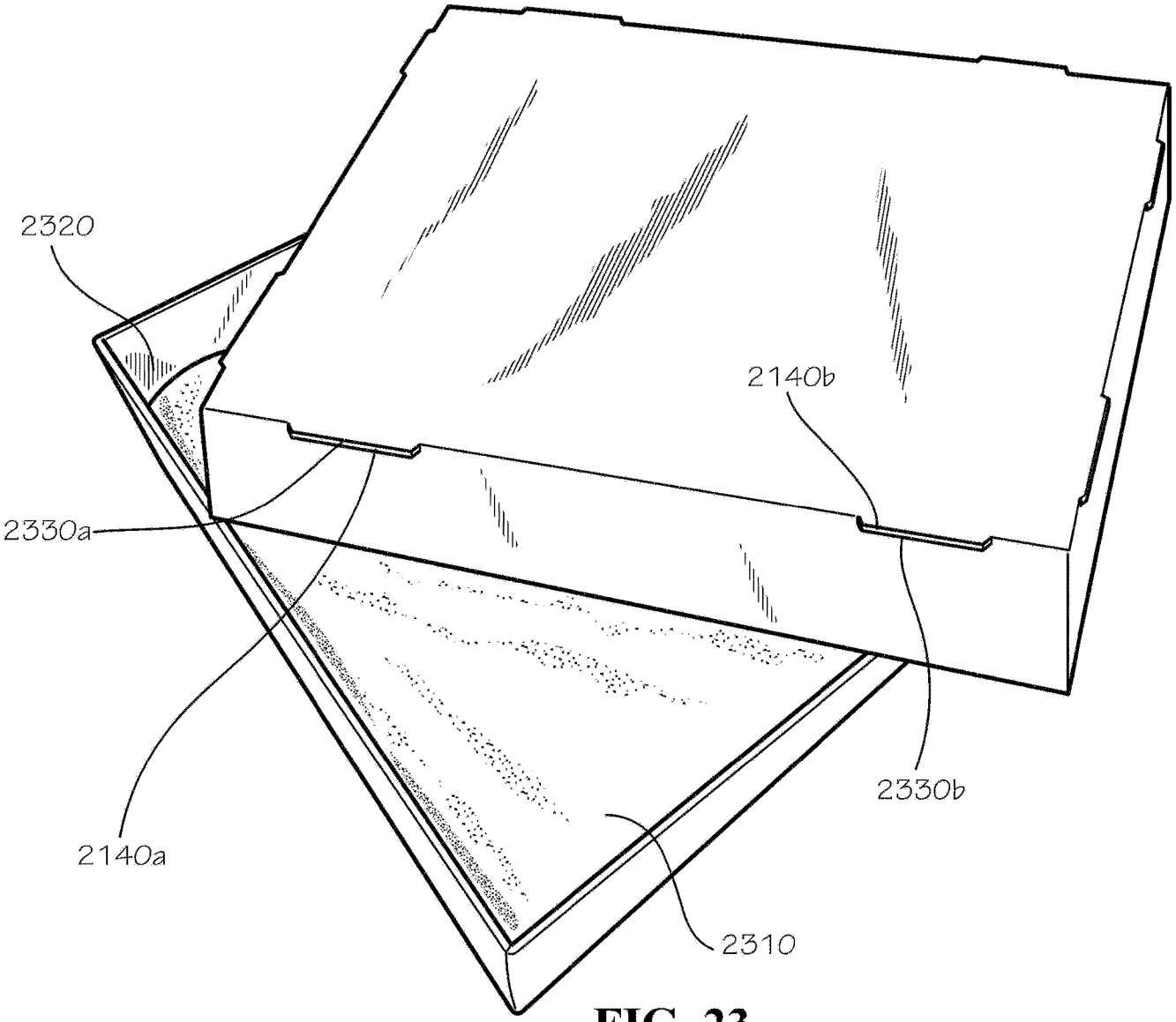
FIG. 23 is a perspective view of the lid of FIG. 19 in a partially assembled configuration.

FIG. 23 is a perspective view of a partially-assembled lid 2000. The lid 2000 can further comprise an insulator such as an insulating pad 2310 between the outer piece 2020 and the inner piece 2010. The side segments 2120*a,b,c,d* of the inner piece 2010 can fold toward a cavity 2320 of the outer piece 2020 in an assembled configuration. Folding the side segments 2120*a,b,c,d* in this way can expose the tabs 2330*a,b* (and others not shown) formed by the tab cuts 2140*a,b,c,d,e,f,g,h*. The tabs 2330*a,b* can be received by the tab slots 2232*a,b,c,d,e,f,g,h* such that the insulating pad 2310 and the inner piece 2010 are secured. The outer piece 2020 can be assembled by sandwiching the side tabs 2222*a,b,c,d* between neighboring connecting segments 2220*b,d* and end segments 2230*b,d*.

Figure 24:
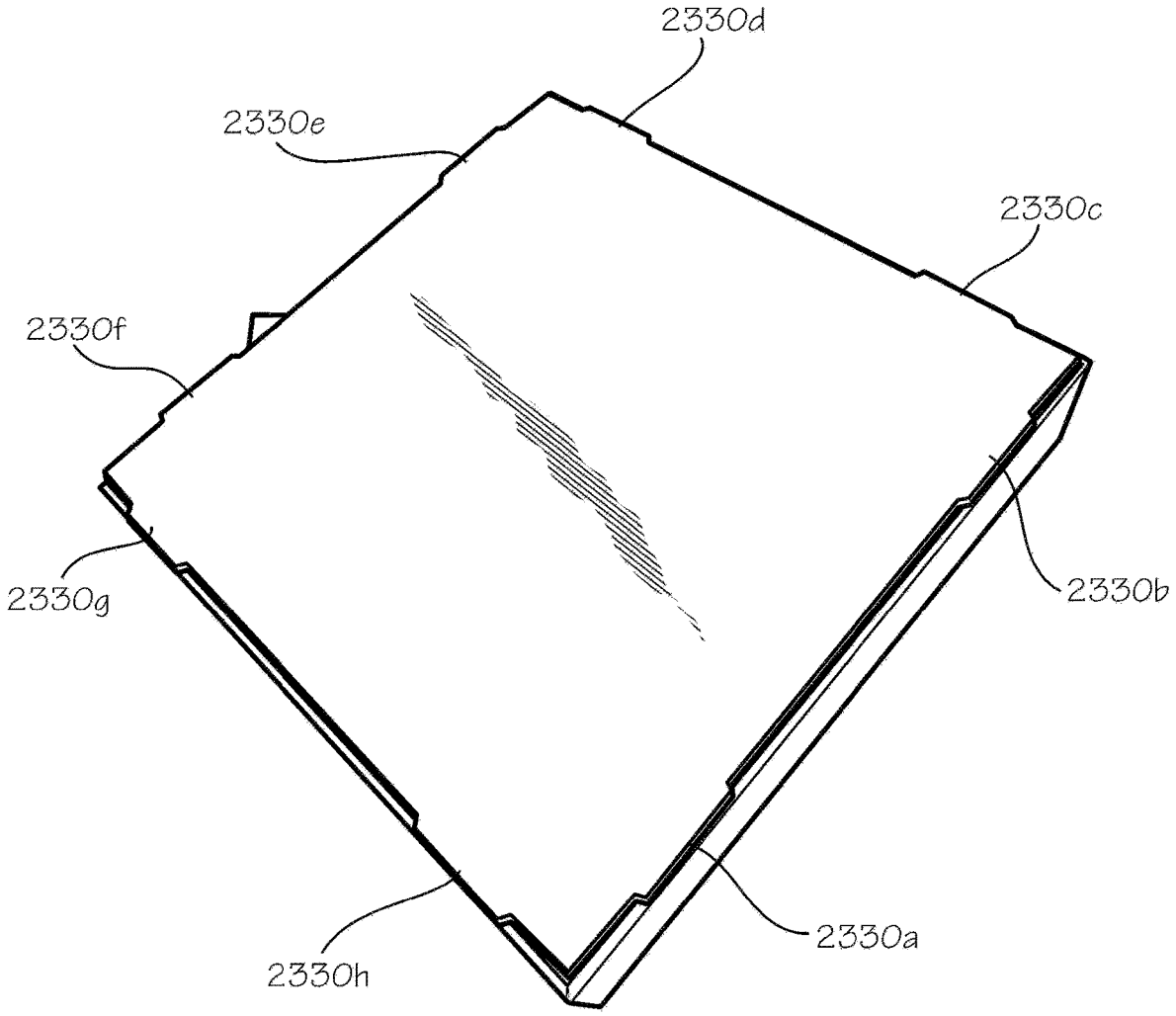
FIG. 24 is a perspective view of the lid of FIG. 19 in another partially assembled configuration prior to one remaining step of pushing the inner piece of the lid into the outer piece of the lid such that tabs of the inner piece are secured by slots of the outer piece.

FIG. 24 shows another perspective view of the inner piece 2010 with its side segments 2120*a,b,c,d* folded into the outer piece 2020, the inner piece 2010 ready to be pushed in, locking the tabs 2330*a,b,c,d,e,f* of the inner piece 2010 into the tab slots 2232*a,b,c,d,e,f,g,h* of the outer piece 2020 (shown in FIG. 22).

Figure 25:
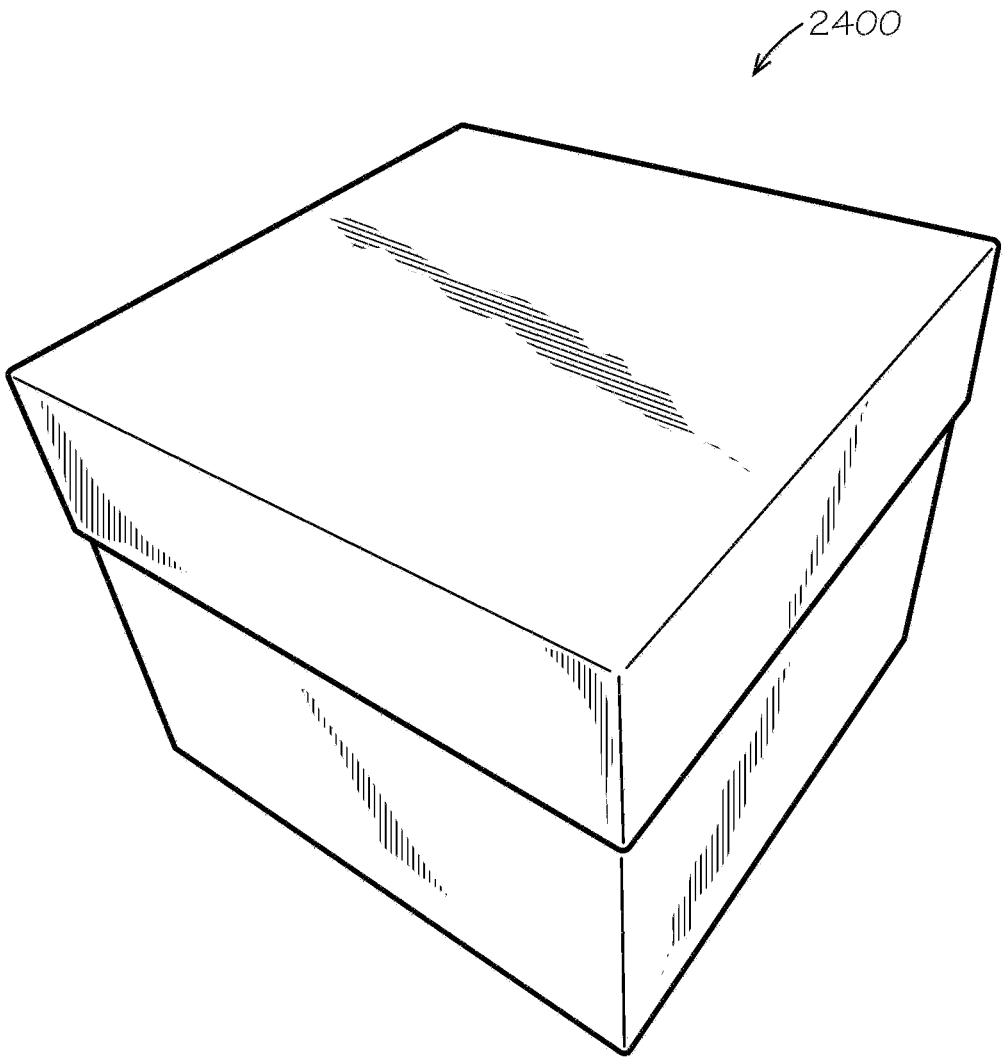
FIG. 25 is a perspective view of the insulated box covered by the lid.

FIG. 25 shows the assembled insulated box 2400 covered by the lid 2000.

The interior piece 500 and the exterior piece 100 of the insulated box 2400, the register 1600, the box insert 1200 with vertical rails 1220, and the inner piece 2010 and the outer piece 2020 of the lid 2000 can each be formed from a single piece of flat material, such as solid cardboard, corrugated cardboard, corrugated plastic, and other materials known in the art. The box insert 1200 with vertical rails 1220 can also be used with or without the register 1600 to maintain a uniform temperature and humidity level within the insulated box 2400. The spaces 1420 between the vertical rails 1220, the cutouts 1620 exposing the bottom 1410 of the cavity 710, and the holes 1610 in the register 1600 can all facilitate air flow and by diffusion and convection.

The registration system 1800 can be configured to place perishable items such as food (not shown) on one side of the register 1600 and a heat transfer element such as an ice pack (not shown) on the other. The ice pack can be place above the food to allow cooling by cold air flowing downward. Multiple registers 1600 can be used.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A box assembly comprising:

an exterior piece comprising:

a middle portion;

a connecting segment coupled to the middle portion by a fold line; and an end segment coupled to the connecting segment by a fold line, the connecting segment positioned substantially perpendicular to the middle portion and the end segment;

an interior piece positioned within the exterior piece, the interior piece comprising a side panel, a space defined between the middle portion and the side panel, the interior piece defining a cavity, the end segment extending into the cavity, the end segment coupled to the side panel; and an insulator positioned at least partially within the space.

2. The box assembly of claim 1, wherein the insulator is positioned in facing engagement with the middle portion, the connecting segment, and the side panel.

3. The box assembly of claim 1, wherein:

the interior piece further comprises a lower portion coupled to the middle portion by a fold line;

the interior piece further comprises a bottom panel coupled to the side panel by a fold line; and the box assembly further comprises a bottom insulator positioned at least partially between the lower portion and the bottom panel.

4. The box assembly of claim 1, wherein:

the middle portion is a first middle portion;

the connecting segment is a first connecting segment;

the end segment is a first end segment;

the side panel is a first side panel;

the exterior piece further comprises:

a second middle portion coupled to the first middle portion by a fold line;

a second connecting portion coupled to the second middle portion by a fold line;

a second end segment coupled to the second connecting portion by a fold line; and an end tab coupled to the second end segment by a fold line; and the end tab is coupled to the first side panel.

5. The box assembly of claim 4, wherein:

the interior piece further comprises:

a side tab coupled to the first side panel by a fold line; and a second side panel positioned adjacent to the first side panel; and the side tab is coupled to the second side panel.

6. The box assembly of claim 5, wherein the side tab is at least partially positioned between the second side panel and the second connecting portion.

7. The box assembly of claim 5, wherein:

the interior piece further comprises a bottom panel;

the first side panel is coupled to the bottom panel by a fold line; and the second side panel is coupled to the bottom panel by a fold line.

8. The box assembly of claim 1, wherein:

the middle portion is a first middle portion;

the side panel is a first side panel;

the exterior piece further comprises a second middle portion and a third middle portion;

the second middle portion and the third middle portion are positioned substantially perpendicular to the first middle portion;

the interior piece further comprises a second side panel and a third side panel;

the first side panel and the third side panel are positioned substantially perpendicular to the second side panel;

the insulator is a first side insulator;

the box assembly further comprises a second side insulator;

the first side insulator is at least partially enclosed in the space by the first middle portion, the second middle portion, the third middle portion, and the first side panel; and the second side insulator is at least partially enclosed in the space by the first side panel, the second side panel, the third side panel, and the second middle portion.

9. The box assembly of claim 8, wherein:

the first middle portion is a front middle portion;

the second middle portion is a right middle portion;

the third middle portion is a left middle portion;

the first side panel is a front side panel;

the second side panel is a right side panel; and the third side panel is a rear side panel.

* * * * *